US007350272B2

(12) United States Patent
Fries

(10) Patent No.: US 7,350,272 B2
(45) Date of Patent: Apr. 1, 2008

(54) HINGE DEVICE

(75) Inventor: Bror Fries, Hishult (SE)

(73) Assignee: Frip AB, Hishult (SE)

( * ) Notice: Subject to any disclaimer, the term of this patent is extended or adjusted under 35 U.S.C. 154(b) by 109 days.

(21) Appl. No.: 10/786,608

(22) Filed: Feb. 25, 2004

(65) Prior Publication Data

US 2004/0200035 A1 Oct. 14, 2004

Related U.S. Application Data

(63) Continuation-in-part of application No. PCT/NO02/00300, filed on Aug. 29, 2002.

(30) Foreign Application Priority Data

Aug. 29, 2001 (NO) ..... 20014197

(51) Int. Cl.
*E05D 7/06* (2006.01)

(52) U.S. Cl. ..... 16/246; 16/241; 16/240; 16/245; 16/236; 16/249

(58) Field of Classification Search ..... 16/236, 16/246, 239, 240, 245, 382
See application file for complete search history.

(56) References Cited

U.S. PATENT DOCUMENTS

| | | | | |
|---|---|---|---|---|
| 994,196 | A | 6/1911 | Reddick | |
| 1,002,394 | A | 9/1911 | Hanson | |
| 2,940,115 | A | 6/1960 | Hansen | |
| 3,325,942 | A | 6/1967 | Bejarano | |
| 3,423,786 | A | 1/1969 | Arias, Jr. et al. | |
| 3,728,758 | A * | 4/1973 | Johansen | 16/257 |
| 3,952,366 | A * | 4/1976 | Rock et al. | 16/235 |
| 3,965,532 | A * | 6/1976 | Wigfall | 16/270 |
| 4,070,728 | A | 1/1978 | Herman | |
| 4,159,557 | A | 7/1979 | Pittasch et al. | |
| 4,825,507 | A | 5/1989 | Killingstad | |
| 4,982,475 | A | 1/1991 | Killingstad | |
| 5,257,437 | A * | 11/1993 | Salice | 16/239 |
| 5,379,487 | A * | 1/1995 | Bowers | 16/240 |
| 5,381,920 | A | 1/1995 | Lin | |
| 5,611,113 | A * | 3/1997 | Rock et al. | 16/246 |
| 5,632,064 | A * | 5/1997 | Lautenschlager | 16/272 |
| 5,646,708 | A * | 7/1997 | Bolle | 351/153 |
| 5,788,351 | A | 8/1998 | Prunty et al. | |
| 5,799,370 | A | 9/1998 | Davidian et al. | |
| 5,806,144 | A | 9/1998 | Fries | |

(Continued)

FOREIGN PATENT DOCUMENTS

| | | |
|---|---|---|
| DK | 132347 | 11/1975 |

(Continued)

*Primary Examiner*—Robert J. Sandy
*Assistant Examiner*—Marcus Menezes
(74) *Attorney, Agent, or Firm*—IPLM Group, P.A.

(57) ABSTRACT

A hinge device where height adjustment, depth adjustment and side adjustment are permitted, wherein a hinge flap is adjustably supported by a rotatable pin with a polygonal flange, the hinge for side adjustment having an adjustable screw body fastened into the door frame for abutment with the rear side of the hinge, and where depth adjustment is provided by allowing a tongue on the hinge flap to form rotatable engagement with a double-headed adjusting screw that is insertable into the door frame parallel to the plane of the hinge flap.

6 Claims, 35 Drawing Sheets

U.S. PATENT DOCUMENTS 6,202,255 B1 * 3/2001 Sitter ..... 16/242
6,553,621 B2 * 4/2003 Isele ..... 16/238

FOREIGN PATENT DOCUMENTS

EP 1 094 183 A2 4/2001
NO 309619 2/2001
WO WO 01/84261 11/2001

* cited by examiner

HINGE DEVICE

This application is a continuation-in-part of PCT/NO02/00300 filed Aug. 29, 2002, entitled "Hinge Device", which claims priority from Norwegian patent application Ser. No. 20014197 filed Aug. 29, 2001, entitled "Hinge Device" which was published under PCT Article 21 (2) in English.

The present invention relates to a hinge device which permits not only height adjustment, but also side adjustment and depth adjustment of the hinge.

The installation of hinges in recesses cut into frames and doors is done almost exclusively at the factory, instead of being done at the building site as was the case earlier. Such preparation is done because it is the cheapest solution and also because it results a higher aesthetic standard. Necessary tolerances in the manufacture of hinges and the difficulty of having 100% of the installation done at the building site have, with the assistance of the law of gravity, the result that the doors will always sag slightly, and slant out from the frame at the top and in at the bottom. This is a growing problem in connection with the design and adjustment of hinges that are suitable for such doors, not least because modern doors, due to requirements of sound, tightness, fire resistance and burglar proofing, are heavy. A high work pace may result in the installation at times not being completely precise. This usually applies to the plumbing of the door frame, and incorrect installation in this connection will mean that the door does not rest true against the rebate in the frame, and consequently is difficult to close to lock properly. The combination of these factors has meant that there has long been a demand for adjustable hinges. However, the difficulty has been to provide strong, but at the same time simple and relatively inexpensive constructions. Moreover, there has been a degree of conservatism in that there has been a desire to continue have established models.

More specifically, the invention relates to a height-adjustable hinge device as disclosed in the preamble of attached claims 1-4, 7, and 8. The invention also relates to a side-adjustable hinge device as disclosed in the preamble of attached claims 10 and 11. In addition, the invention relates to a depth-adjustable hinge device as disclosed in the preamble of attached claim 13. Moreover, the invention relates to a hinge of the snap-in kind, as disclosed in the preamble of attached claims 14-16 and 18-22.

There are a number of known types of height-adjustable hinges, and one solution for height adjustment is based on adjustable abutment against the upper side and the underside respectively of a hinge flap. A solution of this kind can be seen on the left in attached FIG. 7*a*.

There are also a number of known solutions in connection with sideways adjustment of a hinge where means are caused to alter the position of a hinge flap relative to, for example, a door frame by using screws which act on the outside and the inside of the hinge flap, respectively. However, the adjustments that must be made are awkward to carry out in practice, and there has long been a need to find a solution where such sideways adjustment of a hinge can be implemented in a simple manner.

A number of types of means for depth adjustment of a hinge have also been described. Often, such means consist of using guides, interacting ribs or the like in order to be able to adjust the hinge depthwise in a stepwise manner. However, these solutions are awkward in practice and there has therefore been a long-felt need to find solutions which are simple and which at the same time provide the hinge with means for rapid adjustment.

In the case of a hinge where there is the possibility of, for example, height adjustment, side adjustment and/or depth adjustment, it will often be appropriate to make the hinge a hinge of the snap-in type, where there are means allowing a hinge flap to be snapped into a mounting fitting on a door leaf. Often, it has been standard practice to make such mounting fittings of plastics. The use of hinges in connection with heavy doors will make great demands on the holding power (strength) of the mounting fitting. It is an object of the present invention to solve this in a simple, but effective manner.

The object of the present invention is to be able to adjust the height, side and depth of a hinge easily and quickly using simple tools. In connection with hinges of the snap-in type, the invention with its special mounting fittings will provide a symmetric solution, eliminating the need for right-hand and left-hand doors. With fixed hinges of the snap-in type, the door frame can also be made symmetric. Moreover, the invention can in a simple manner enable established, fixed, lift-off butt hinges to also be adjustable, optionally not only with regard to height, but also with regard to side adjustment and depth adjustment. In hinges of the snap-in type, the mounting fitting has conventionally been made of a plastic material as the engaging tongue that is to snap into the hinge flap must have a spring action. However, this has been a disadvantage, especially in connection with fire doors, as there are requirements stipulating that the material of the hinge should be non-flammable. There is also some uncertainty as to whether plastics may be subject to fatigue when such mounting fittings are used in connection with hinges that are to support heavy doors. Accordingly, the present invention permits the mounting fitting used in connection with hinges of the snap-in type to be made alternatively with or without depth adjustment, the mounting fitting in such a case, e.g., being cast in a metal, e.g., zinc, samak, brass etc. The invention also permits the mounting fitting to be made partly or wholly of a steel band material, for example of the spring steel type.

The characteristic features of the inventive height-adjustable hinge device are set forth in the characterising clauses of respective claims 1-4, 7, and 8 and associated sub-claims.

The characteristic features of the side-adjustable hinge device are set forth in the characterising clause of attached claim 10 and 11.

The depth-adjustable hinge device according to the invention is disclosed the characterising clause of attached claim 13.

The different embodiments of the hinge device of the snap-in type are apparent from the characterising clauses of attached claims 14-16 and 18-22, and the sub-claims associated therewith.

The invention will now be described in more detail with reference to the attached exemplary embodiments that can be seen from the attached drawings.

Figures 28A, 28B:
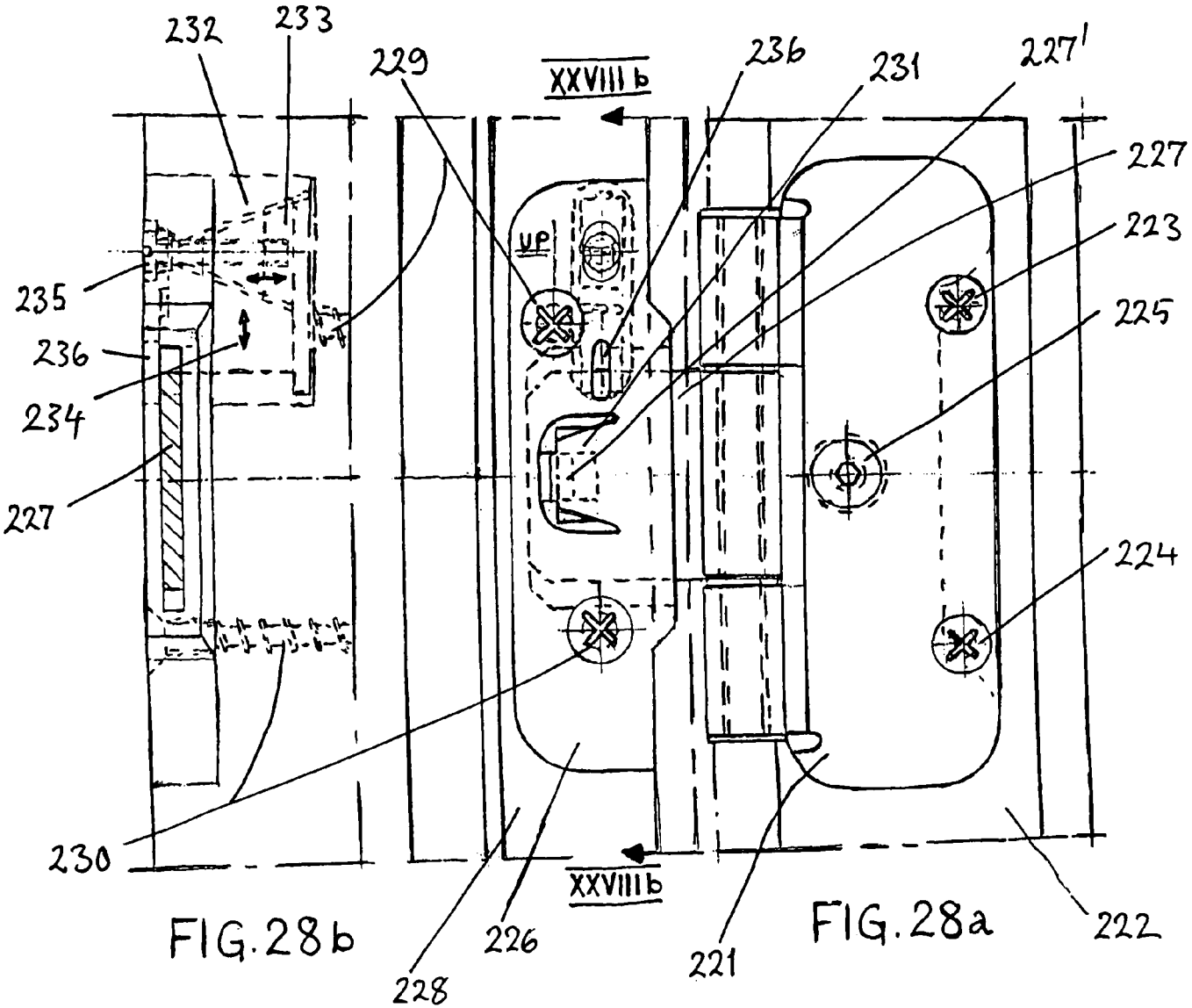

FIG. 28*a* shows a nineteenth embodiment of the snap-in type hinge device with a thirteenth embodiment of height adjustment, and with a solution for snap engagement like the solution in FIG. 7, and FIG. 28*b* shows section XXVIIIb-XXVIIIb on FIG. 28*a*.

FIG. 1 shows a height-adjustable hinge where the hinge flap 1 is fixable to a door frame 2 with screws 3, 4 which are placed in elongate holes 3', 4' in the hinge flap 1. The use such elongate holes allows height and depth adjustment of the hinge to be made without the screws having to be removed. Referring to FIG. 2, it will be understood that the depth of a recess 5 is made slightly deeper and longer in order to permit depth and height adjustment respectively. A protrusion 6 on the hinge flap provides the required tilt point for the hinge flap in cooperation with an adjustable screw body 7 that can be fastened into the frame 2 and will bear against the rear side of the hinge flap 1. A screw 8 can be fastened into the screw body 7 through a hole 9 in the hinge flap so as to be able to fix the hinge flap 1 to the screw body 7 and at the same time provide angular adjustment of the hinge flap 1 relative to the adjacent part 15 of the frame 2 in cooperation with the protrusion 6 on the hinge flap 1. However, it is conceivable that instead of the protrusion 6 being on the hinge flap it could be located in the recess 5.

Figure 1A:
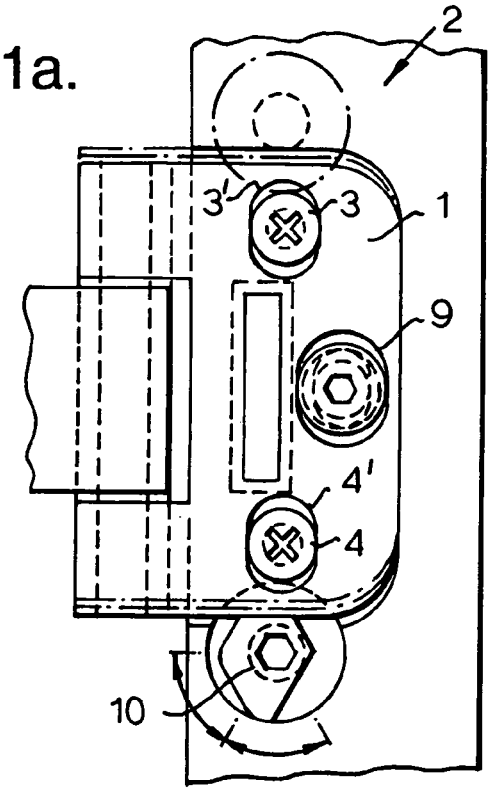
FIG. 1 shows a first embodiment of a height-adjustable hinge.
Figure 1B:
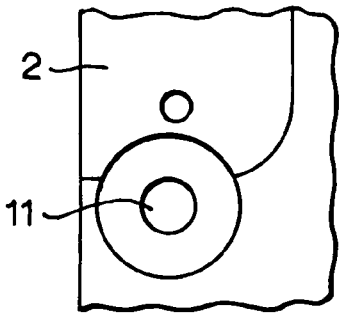
Figure 1C:
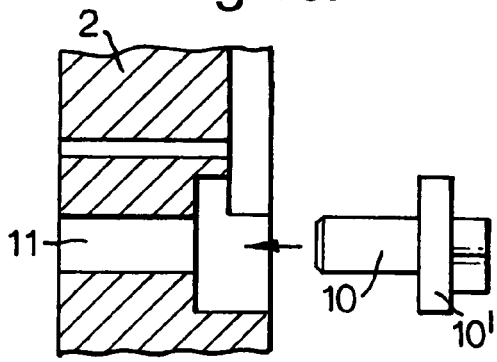
Figure 1D:
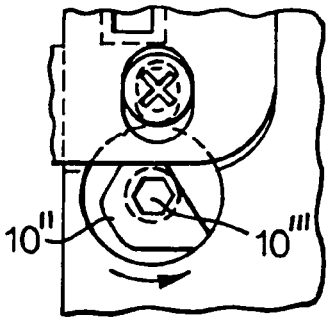
Figure 1E:
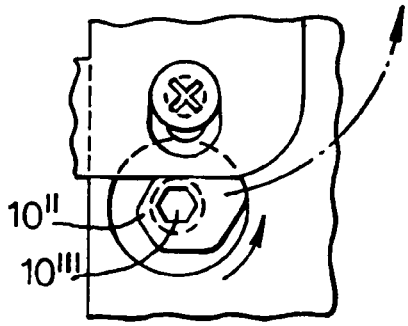

As shown in FIG. 1*a*, the illustrated device has for height adjustment a means for stepwise height adjustment. This means consists of a pin 10 that is equipped with a polygonal flange 10' with the respective edges 10" at different distances from the centre 10'" of the pin. The pin 10 is rotatable in a recess 11 in the frame 2. As will be apparent from FIGS. 1*a*, 1*d* and 1*e*, turning the pin will cause a flange edge 10" to come to rest against the underside or lower edge of the hinge flap 1 in stepwise varying distance from the pin centre 10'" when the pin is turned.

Figure 17:
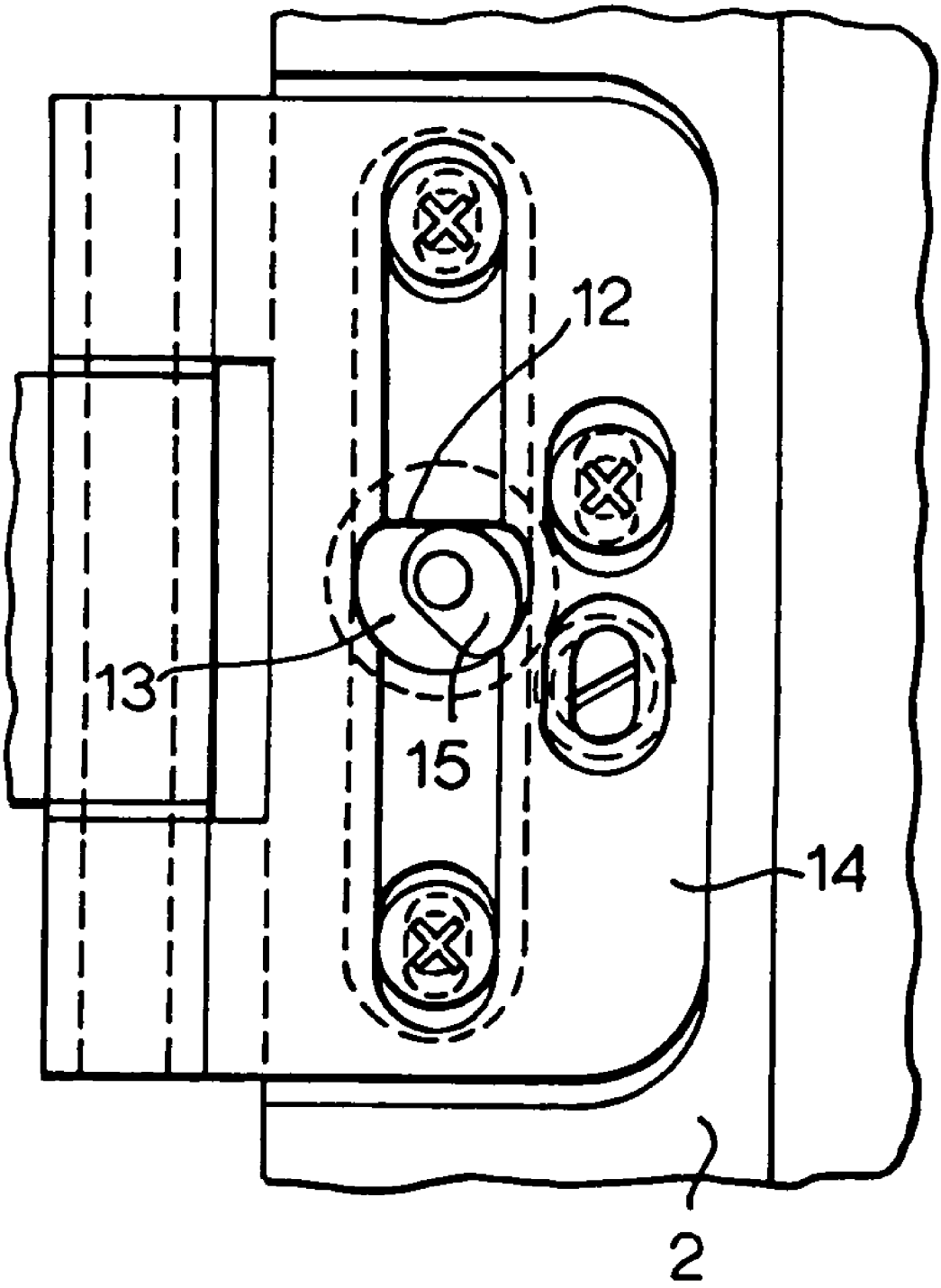
FIG. 17 shows a sixth embodiment of a height-adjustable hinge.

FIG. 17 indicates a variant of the solution shown in FIG. 1, where the real difference is in fact that there is a collar 12 in an opening 13 in a hinge flap 14, so that when a pin 15, which has a polygonal edge, is turned, the hinge can be adjusted as regards its height relative to the door frame.

Figure 2A:
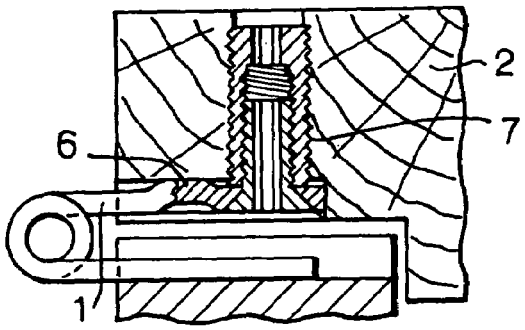
FIG. 2 shows side adjustment of such a hinge in a first embodiment thereof.
Figure 2B:
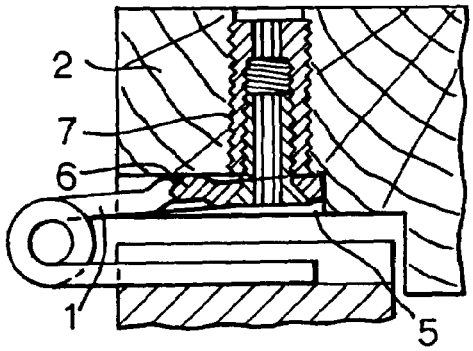
Figure 2C:
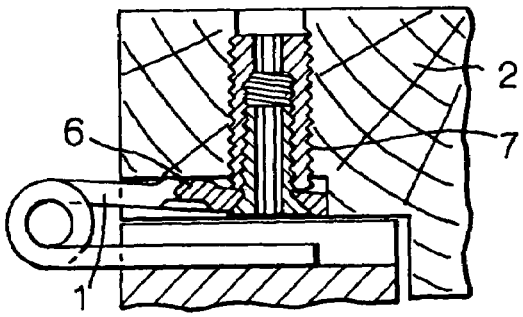
Figure 2D:
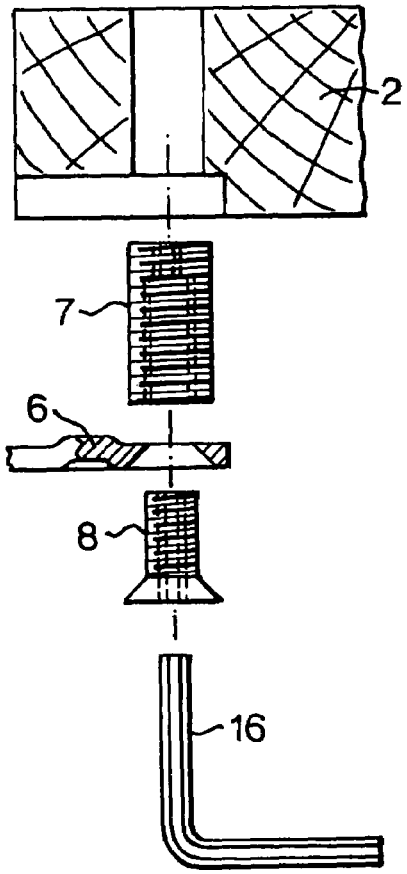
Figure 2E:
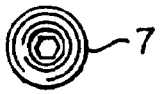
Figure 2F:
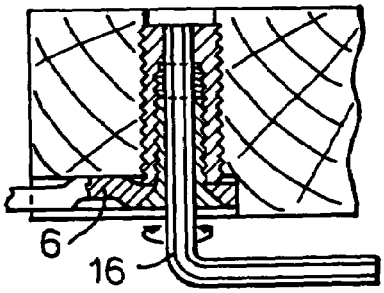
Figure 3C:
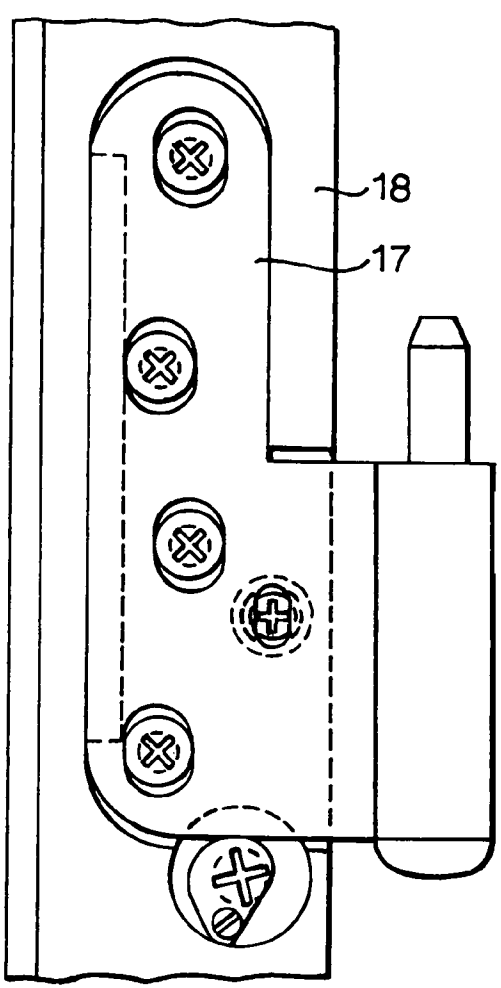
FIG. 3 shows a second embodiment of a height-adjustable hinge, where FIG. 4 indicates in a second embodiment the side adjustment of the hinge.
Figure 3B:
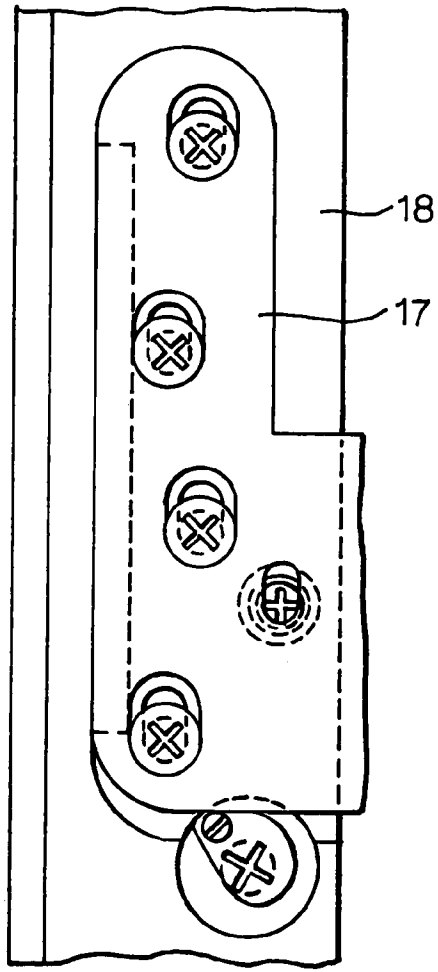
Figure 3A:
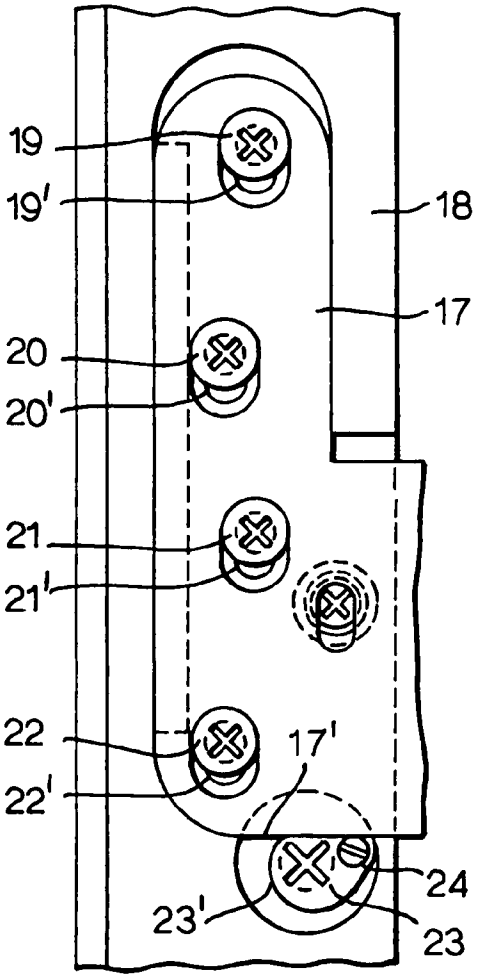
Figure 3D:
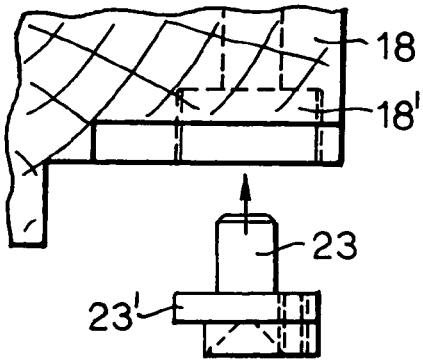
Figure 3E:
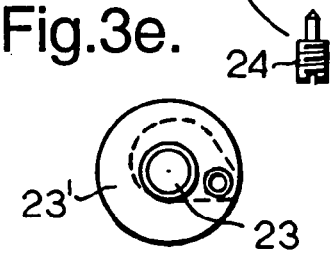
Figure 4A:
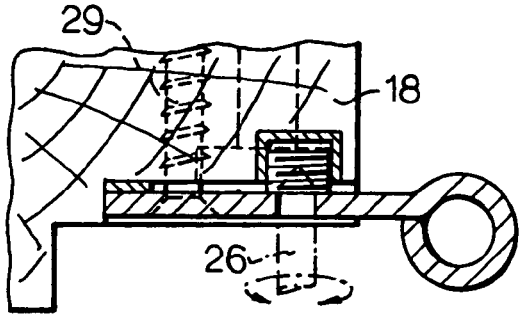
Figure 4B:
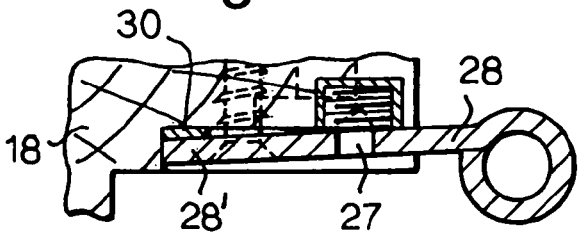
Figure 4C:
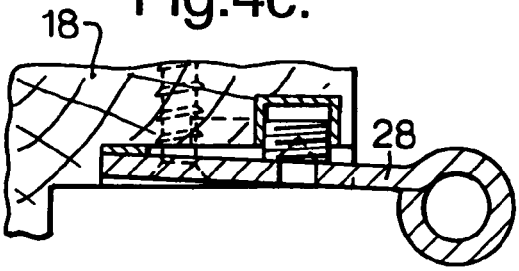
Figure 4D:
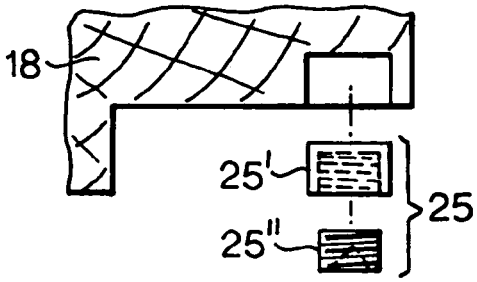

In the solution shown in FIG. 2, FIG. 2*e* is an end view of the screw body 7. It will be understood that a simple tool, e.g., an Allen key 16, can be used to adjust both the position of the screw body 7 relative to the frame and also to fasten the screw 8 in the screw body 7.

FIG. 3 shows a hinge which has means for both height adjustment and depth adjustment. A hinge flap 17 is fixable to a door frame 18 with, for example, screws 19-22 which are passed through respective elongate holes 19'-22' in the hinge flap 17. The means for stepwise height adjustment consists of a pin 23 which is pivotally connected to the frame in a way similar to that shown in connection with, e.g., FIG. 1*c*, and which is equipped with a rounded, eccentrically supported flange 23'. Any part of the flange circumference can be brought into abutment with the lower edge of the hinge flap 17'. As the illustrated flange 23' is not necessarily made having steps, like the embodiment shown in FIG. 1, it would be advantageous to be able to fix the flange against rotation by means of a set screw 24. The pin 23 has its pivotal support in the door frame 18 via a recess 18' in the frame.

The side adjustment of the hinge shown in FIG. 3 is illustrated in more detail in FIG. 4. An adjustable screw body 25 can be adjustably fastened into the frame 18 so that it comes to rest against the rear side of the hinge, as can be seen clearly from FIG. 4*c*. The screw body 25 consists of a first body part 25' which can be fixedly secured in the frame, and a screw part 25" which forms adjustable threaded engagement with the first part 25', as can be seen clearly from FIGS. 4*a*-4*c*. Adjustment of the screw 25" relative to the fixed part 25' is carried out using a known tool 26 per se which engages with the screw 25" via a hole 27 in the hinge flap 28. To make the adjustment, the fixing screws 29 for the hinge flap 28 must be loosened slightly while the adjustment of the screw 25" takes place, whereupon the screws 29 are tightened. As shown in FIGS. 4*a*-4*c*, the hinge flap 28 has a tilt point 30 at its free end 28'.

The angle of the hinge flap relative to the adjacent portion of the frame 18 is made possible in this way.

Figures 5A, 5B, 5C:
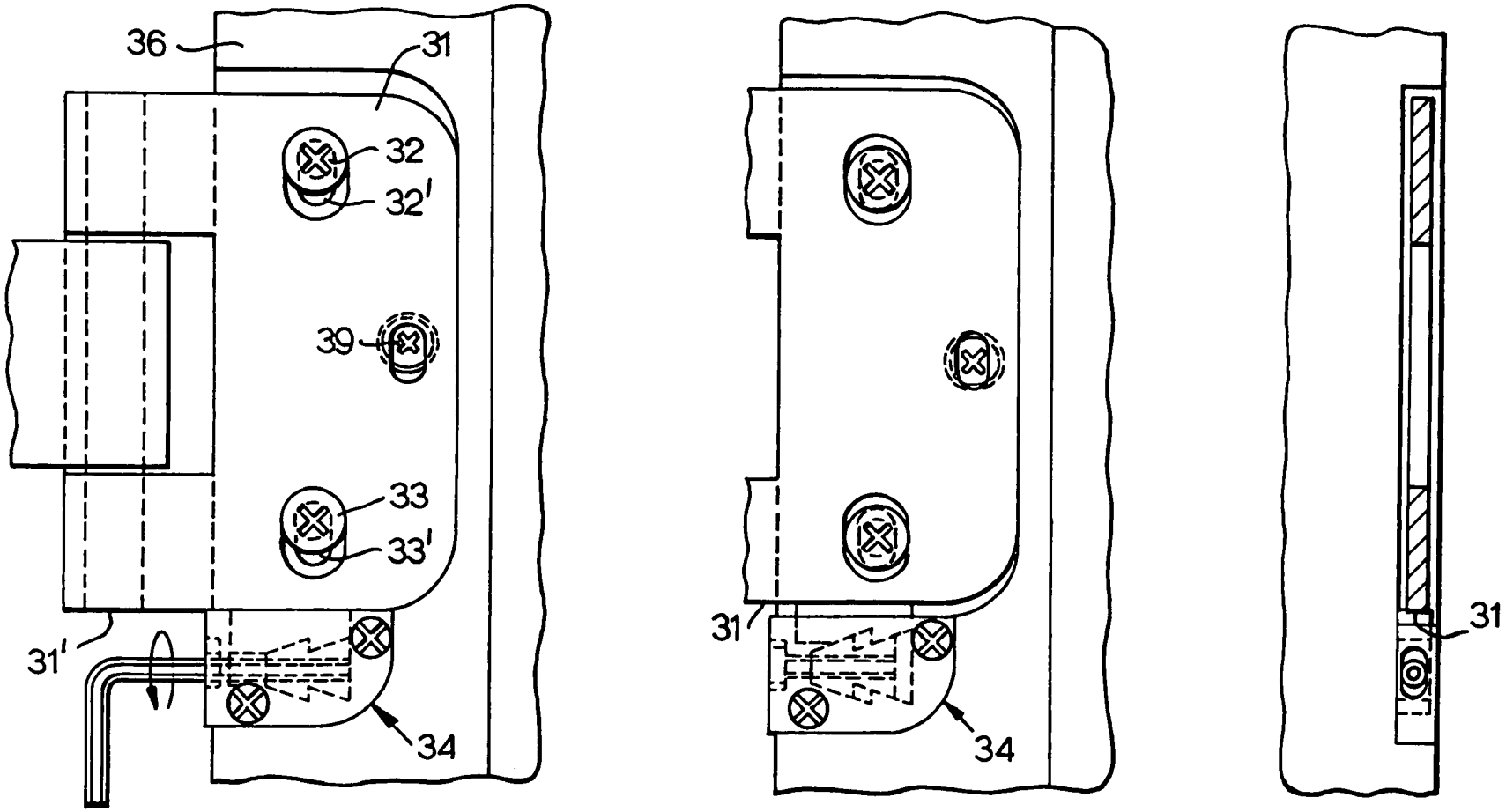
FIG. 5 shows a third embodiment of a height-adjustable hinge, where FIG. 6 indicates in a third embodiment the side adjustment of the hinge.

Another variant of the inventive, height-adjustable hinge can be seen from the embodiment shown in FIG. 5*a*. In this figure there is a hinge flap 31 which has , for example, fixing screws 32, 33 that are passed through holes 32', 33' in the hinge flap, and where there is also provided a means 34 for height adjustment. This means 34 consists of a wedge device 35, 35' that is mounted on a door frame 36 and which is steplessly movable parallel to the lower edge 31' of the hinge flap, a slide 35" which rests against the lower edge 31' of the hinge flap being urged to move either up or down. An adjusting screw 37 cooperates with the wedge device part 35 to be able to adjust the position of this wedge part relative to the wedge device part 35'.

Figure 5E:
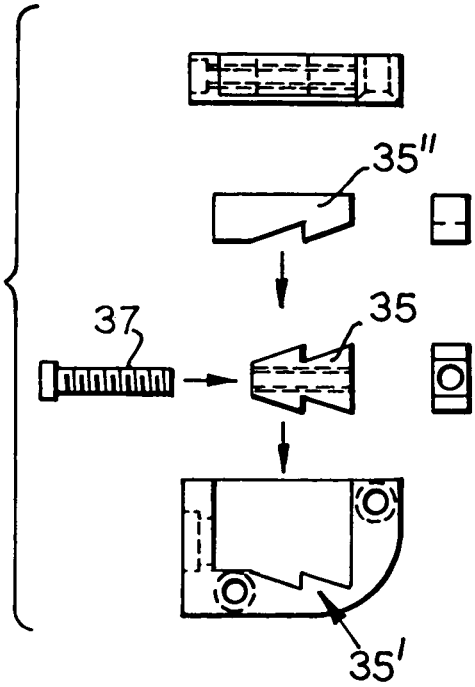
Figure 5D:
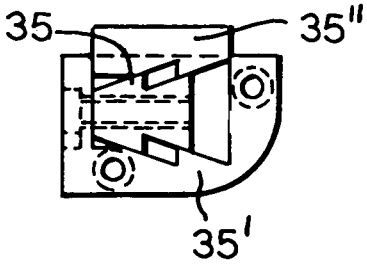
Figure 6:
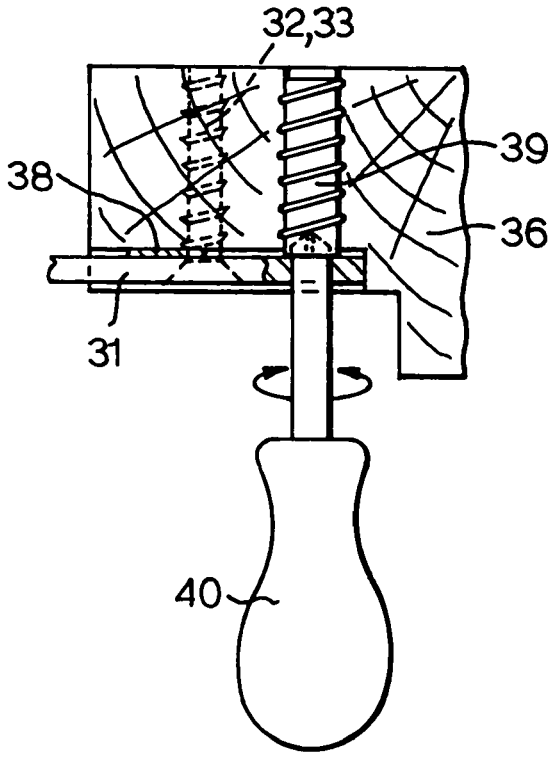

FIG. 6 shows how side adjustment of the hinge shown in FIG. 5 can be carried out, and the principle is per se the same here as that shown in connection with FIG. 4. The hinge flap 31 is tiltable about a tilt point 38 and an adjusting screw 39 rests against the rear side of the hinge flap and is adjustable against the rear side of the hinge flap 31 by screwing the screw body 39 in or out relative to the frame 36 using a tool 40. In an operation of this kind, it will inevitably be necessary to loosen the screws 32; 33 slightly, whereupon after adjustment these screws are tightened again.

The solution in FIG. 7 shows a hinge that is height-adjustable, depth-adjustable and side-adjustable. The side adjustment for this hinge can be seen in some more detail from that shown in FIG. 8.

This figure shows a hinge of the snap-in type, where one of the hinge flaps 41 can be snapped into a mounting fitting 42 that is fitted on a door leaf 43. The mounting fitting is fixed to the door leaf 43 with screws 44, 45, 46 and 47. Pivots pins 48, 49 can with their respective, graduated flange portions, such as flange portion 10' on the pivot 10 shown in FIG. 1, be brought into abutment respectively with the upper and lower edge of the hinge flap 41. The hinge flap 41 has in a known manner a hole 41' for engagement with an engaging lug 42' on the mounting fitting 42, as can be seen from FIG. 7*c*.

In this solution the pins 48 and 49 must inevitably be turned in a coordinated operation, so that the turning of one pin does not prevent the turning of the other.

To provide depth adjustment of the hinge, the hinge has a hinge flap 50 fixable to the door frame 51 with fixing screws 52, 53, 54 which are placed in respective holes 52', 53'. 54' that are elongate in the depth direction. The hinge flap 50 also has a tongue 50' which lies at 90° to the plane of the hinge flap 50. This tongue 50' forms rotatable engagement with a double-headed adjusting screw 55 which is insertable into the door frame parallel to the plane of the hinge flap 50. The gradual depth adjustment thus takes place by turning the screw 55 and then fixing the hinge flap 50 with the said screws 52, 54.

Figure 7A:
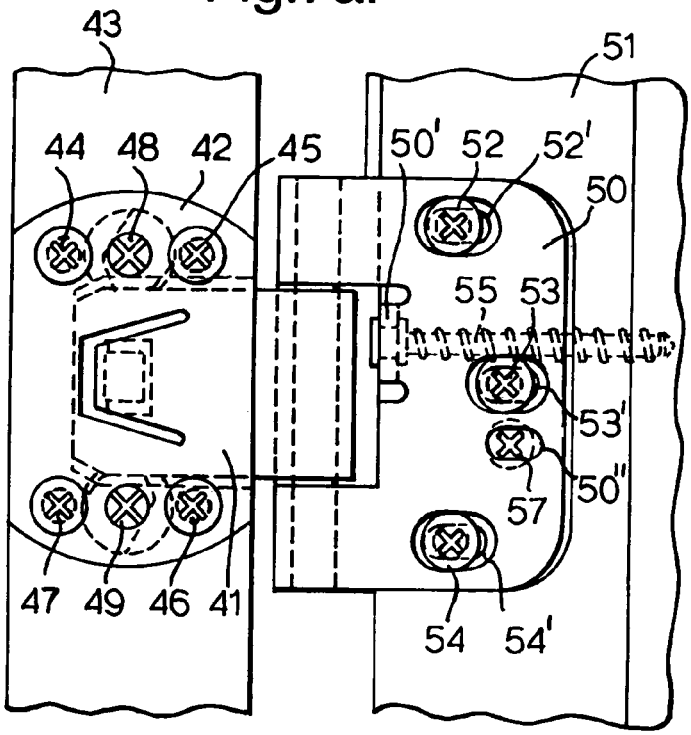
FIG. 7 shows a hinge of the snap-in type where there is the possibility of height adjustment as shown in a fourth embodiment that is known per se, and at the same time indicates a solution for depth adjustment of the hinge and a special case where the depth adjustment involves a safety solution, whilst FIG. 8 indicates a fourth embodiment of the side adjustment of the hinge.
Figure 7B:
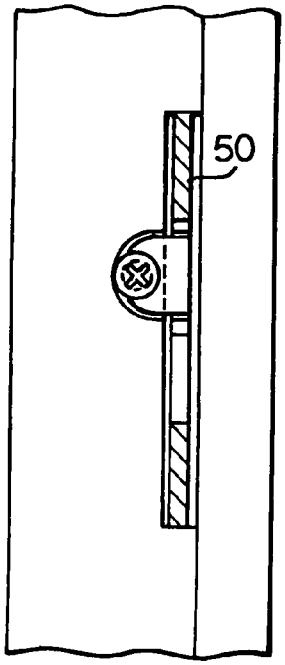
Figure 7C:
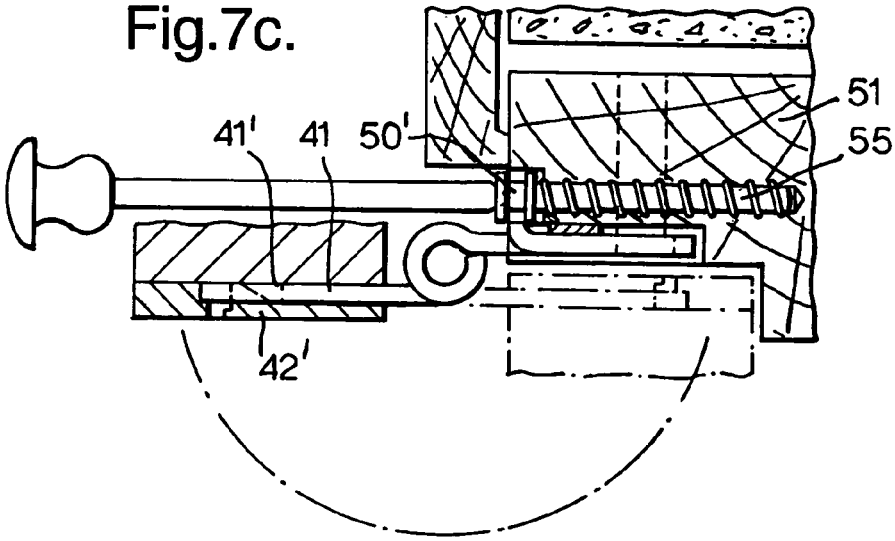
Figure 7D:
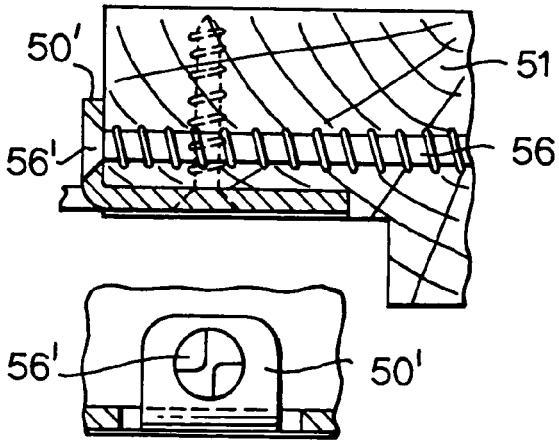

FIG. 7*d* shows a variant of the solution just described for depth adjustment where the tongue 50' is used together with a fixing screw 56 of the one-way screw type having a head 56' which only allows the screw to be screwed into the door frame, but not out of it. A solution of this kind will naturally cause the fixing of the hinge to the door frame to be further secured compared with the securing that is available by means of the said screws 52-54.

Figure 8A:
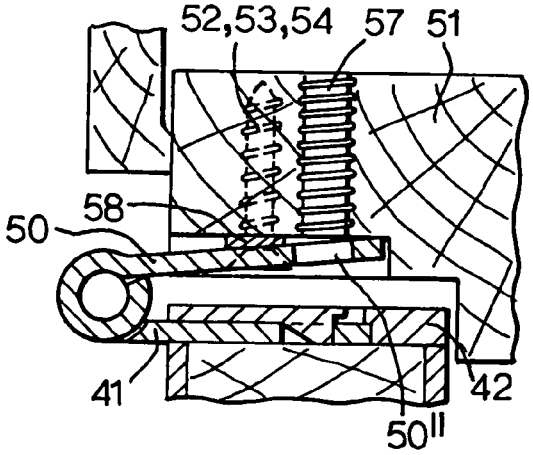
Figure 8B:
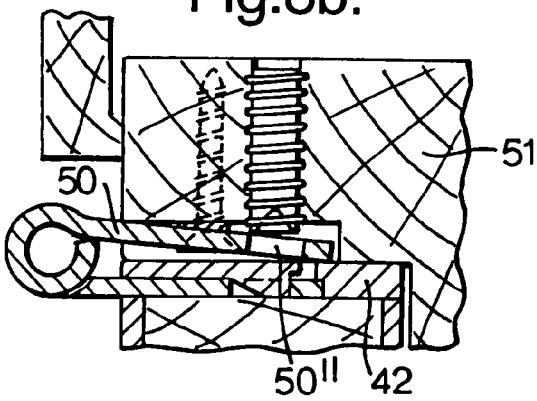
Figure 9A:
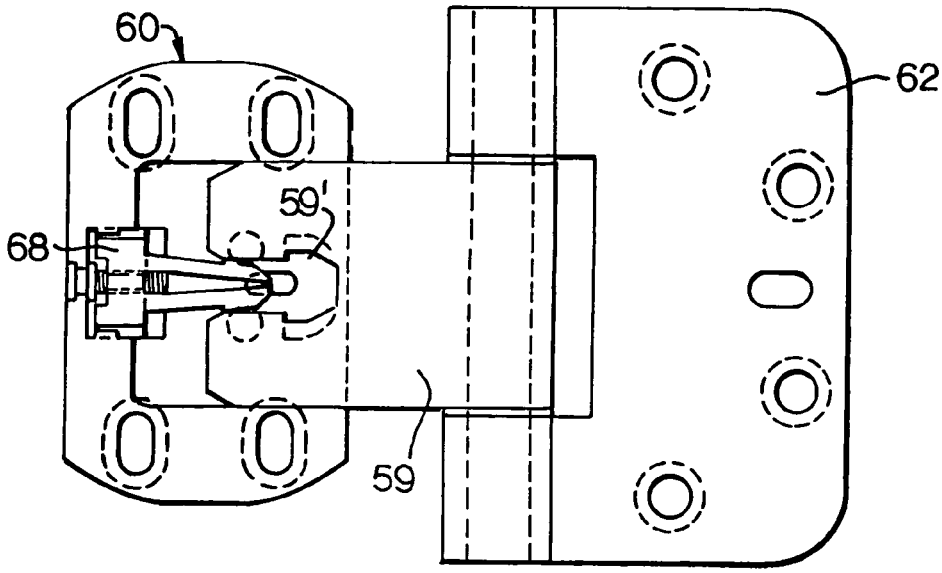
FIG. 9 shows a hinge of the snap-in type in a first embodiment thereof, where there is a second solution for depth adjustment, and where at the same time there is also a fifth embodiment relating to vertical adjustment, and with a simultaneous indication of a fifth embodiment of side adjustment.
Figure 9B:
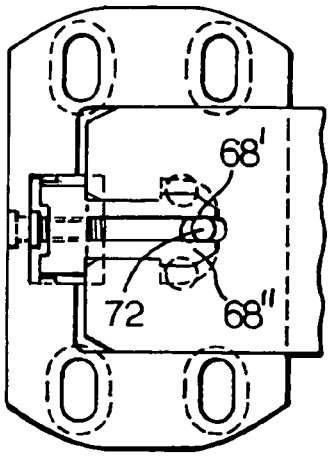
Figure 9C:
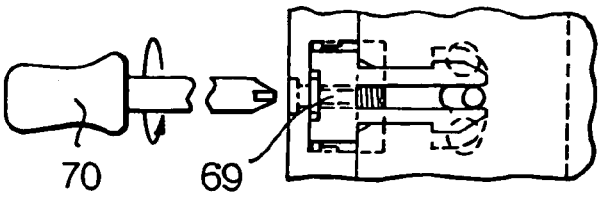
Figure 9D:
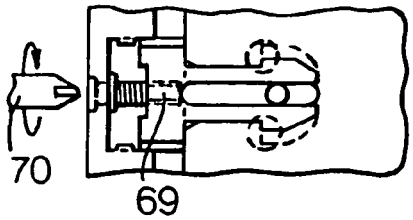

As mentioned, the side adjustment of the hinge can be seen from FIG. 8*a*. Here too, an adjustable screw body 57 is provided that is fastened into the frame 51 and brought into abutment with the rear side of the hinge flap 50. The screw body can be turned by using a tool (not shown in FIG. 8) that is insertable through a hole 50" in the hinge flap 50. For side adjustment of the hinge, the fixing screws 52; 53; 54 must be loosened a little whilst the adjustment of the screw 57 takes place, whereupon the screws must be tightened. The hinge flap 50 is designed to be able to tilt about a tilt point which in FIG. 8*a* is indicated by the reference numeral 58. In the embodiment shown in FIG. 9, depth adjustment could be carried out as just described in connection with FIG. 8. This description will therefore not be repeated. The depth adjustment screw 57 is also indicated in FIG. 9*e*.

In the solution shown in FIG. 9 there is a hinge which, as mentioned, is not only is height-adjustable, but also depth-adjustable. One of the flaps of the hinge, here indicated by the reference numeral 59, can be snapped into a mounting fitting 60 that is mounted on a door leaf 61. The other hinge flap 62 is fixed to the door frame 63 with fixing screws 64, 65, 66 and 67. This part of the hinge is thus only adapted for sideways adjustment, but not for height adjustment or depth adjustment.

The hinge flap 59 can be snapped into the mounting fitting 60 so as to engage with a male snap-in member 68, and where the male snap-in member engages with a cut-out or receiving slot 59'. The male snap-in member 68 may be slidably mounted in the insertion fitting 60 and could be adjusted steplessly, as indicated in FIG. 9*c* and FIG. 9*d*, by means of a double-headed adjusting screw 69 that can be actuated by a tool 70. A simple form of depth adjustment is thus obtained in connection with a hinge of the snap-in type.

Figure 9F:
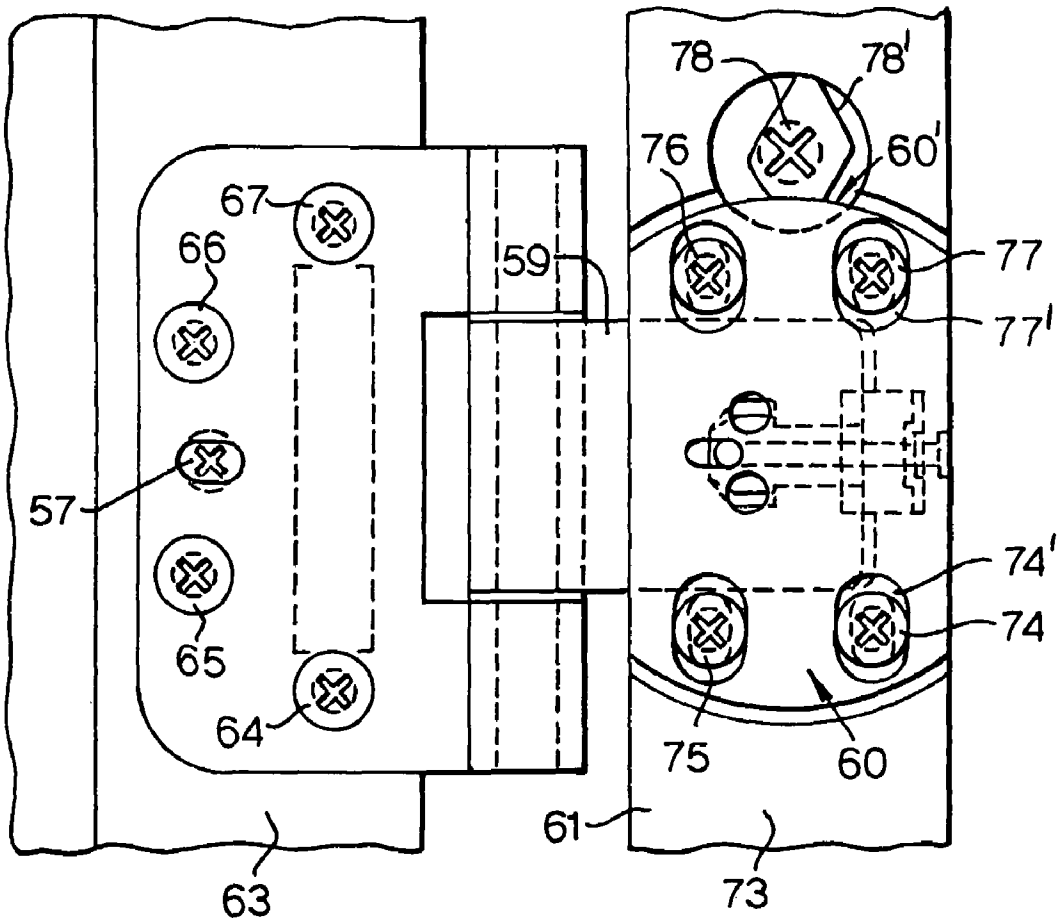
Figure 9E:
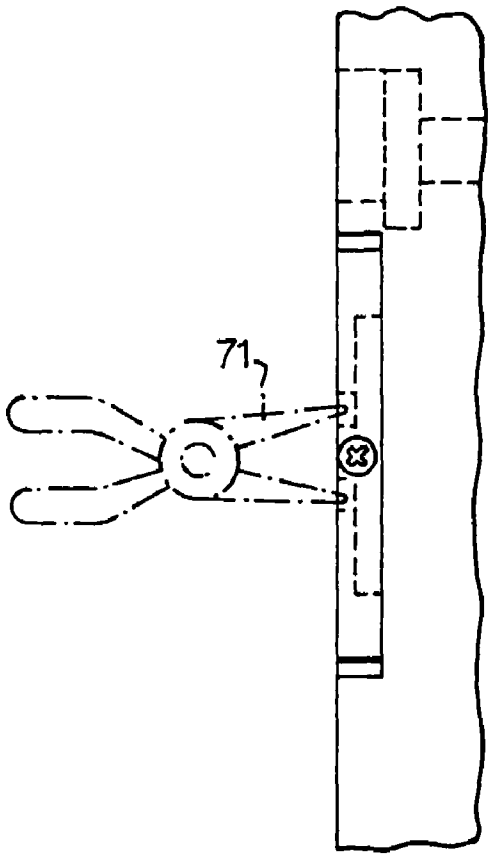
Figure 10A:
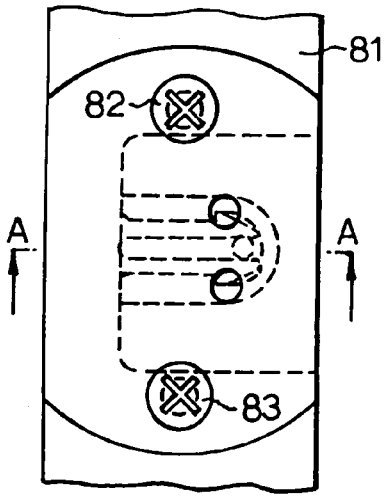
FIG. 10 shows in connection with a second embodiment of a hinge of the snap-in type a mounting fitting for use with such a hinge.
Figure 10B:
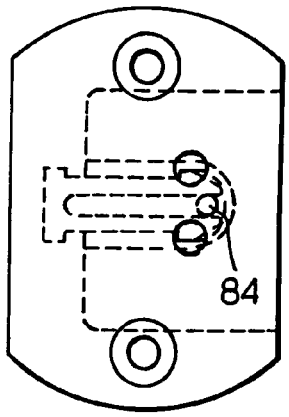
Figure 10C:
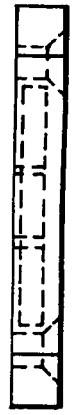
Figure 10D:
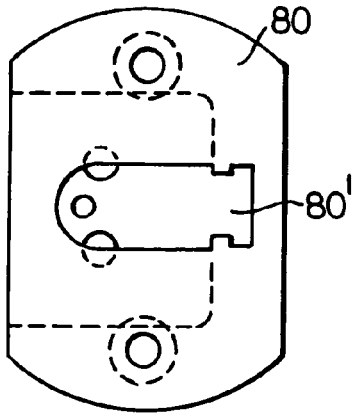
Figure 10E:
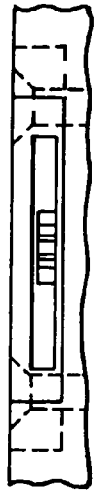
Figure 10F:
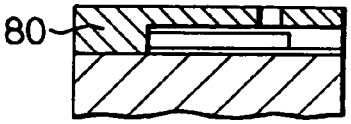
Figure 10G:
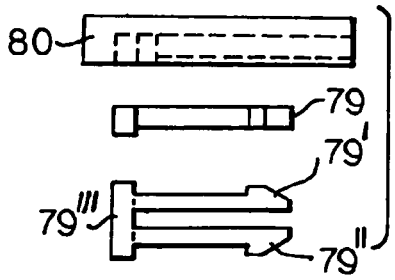

To release the hinge flap 59 from the insertion fitting 60, a tool 71 of the pliers-type can be used and can be inserted, as shown in FIG. 9*f*, to move the two engagement pins on the male snap-in member towards one another and thus out of engagement with the receiving slot 59'. This is indicated in some more detail in FIG. 9*e* and FIG. 9*f*. To ensure that the two catches 68', 68" in a normal situation cannot be moved towards each other, a locking pin 72 may be positioned between these catches 68', 68". In a manner known per se, a mounting fitting 60 of this kind is fixed to a door leaf 73 with fixing screws 74, 75, 76, 77 which are passed through elongate holes 74'-77' in the mounting fitting to provide height adjustment of the fitting 60. The height adjustment is provided by means of a pin 78 that is pivotally connected to the door leaf 73 and that is equipped with a polygonal flange 78' with its respective edges at different distances from the centre of the pin, as also explained in connection with FIG. 1. Any one of the flange edges on the pin 78 can be brought into abutment with an upper edge 60' of the mounting fitting 60.

The solution shown in FIG. 10 differs from the solution shown in FIG. 9 in that in this case there is no indication of depth adjustment or height adjustment in connection with the hinge insertion fitting. As was shown and explained in connection with FIG. 9, the hinge flap that is to be inserted into the insertion fitting on a door leaf is provided with a receiving slot 59' for engagement with a male snap-in member 79 having two snap catches 79', 79" as shown in FIG. 10*g* for fixing in a base part 80 of the insertion fitting. The male snap-in member 70 has an anchoring member 79'" that fits into a recess 80' on the insertion fitting 80, as shown in FIG. 10*d*. Thus, the male snap-in member 79 is fixed relative to the fitting 80. The insertion fitting 80 is fixed to the door leaf 81 with fixing screws 82, 83 as shown in FIG. 10*a*. As also explained in connection with FIG. 9, it may be appropriate to place a locking pin 84 between the catches 79', 79" to prevent unintentional release from the hinge flap, e.g., when the hinge is loaded.

FIG. 11 shows a variant of the solution shown in FIG. 10 where the male snap-in member 85 is made having just one catch 85' for engagement with a catch-shaped receiving slot 86 on the insertable hinge flap 87. Also in this solution, a locking pin 88 may be provided to prevent unintentional release of the engagement between the receiving slot and the male snap-in member.

Figure 11A:
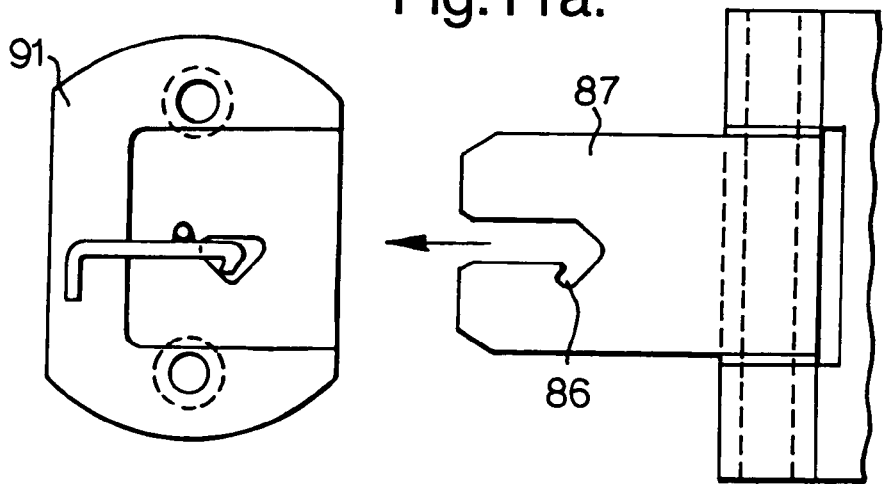
FIG. 11 shows a third embodiment of a hinge of the snap-in type with a specially designed mounting fitting, and where a third embodiment of depth adjustment is indicated.
Figure 11B:
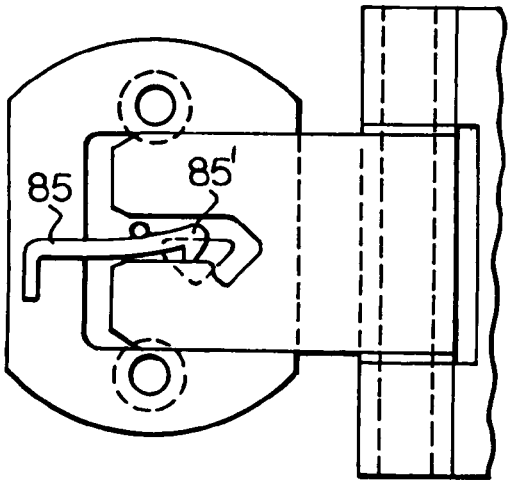
Figure 11C:
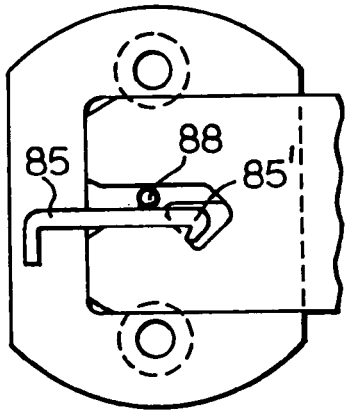
Figure 11D:
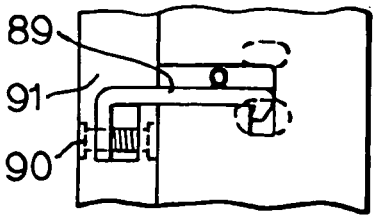
Figure 12A:
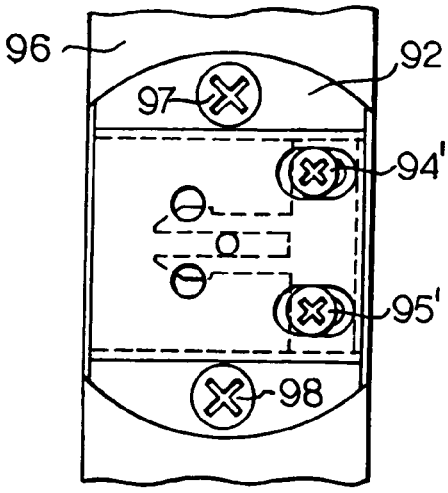
FIG. 12 shows in connection with a fourth embodiment of the hinge device of the snap-in type an insertion fitting which permits depth adjustment of the hinge according to a fourth embodiment.
Figure 12B:
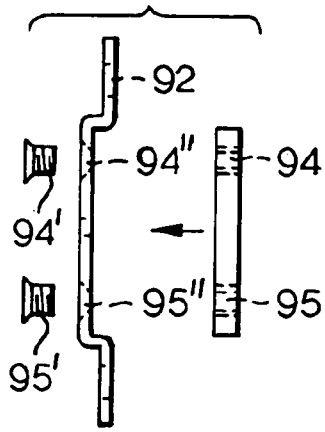
Figure 12C:
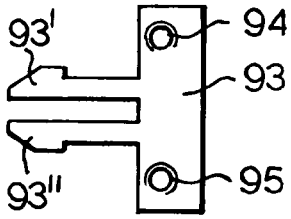
Figure 12D:
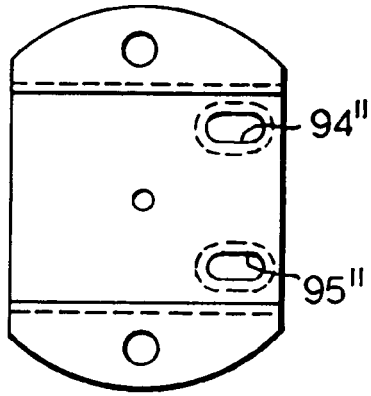
Figure 12E:
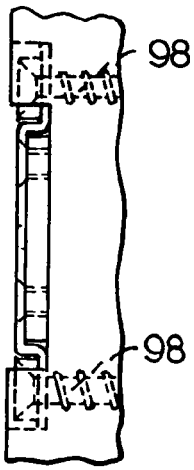
Figure 12F:
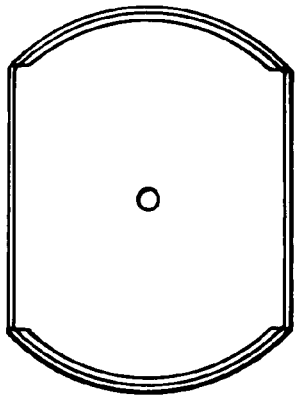
Figure 12G:
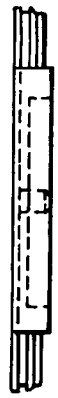
Figure 13A:
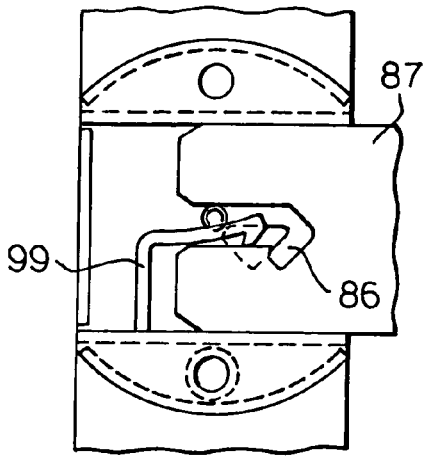
FIG. 13 shows a fifth embodiment of a hinge device of the snap-in type.
Figure 13B:
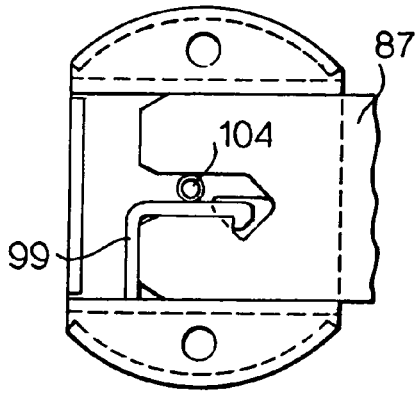
Figure 13C:
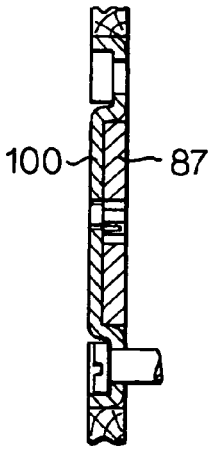
Figure 13D:
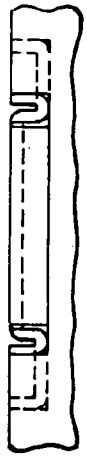
Figure 13E:
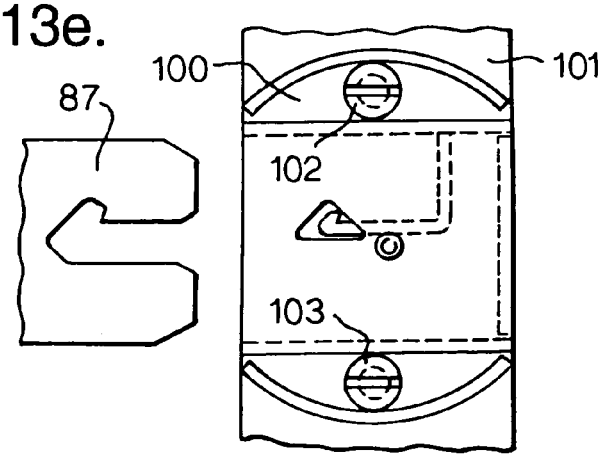
Figure 14A:
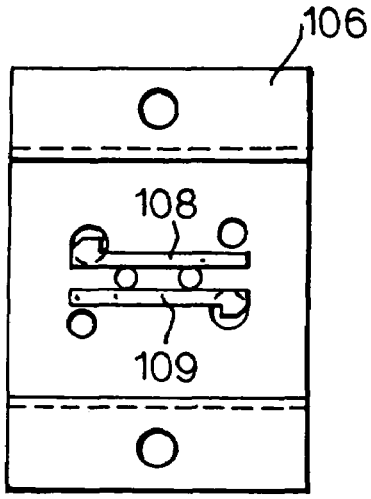
FIG. 14 shows a sixth embodiment of a hinge of the snap-in type with details related to the mounting fitting.
Figure 14B:
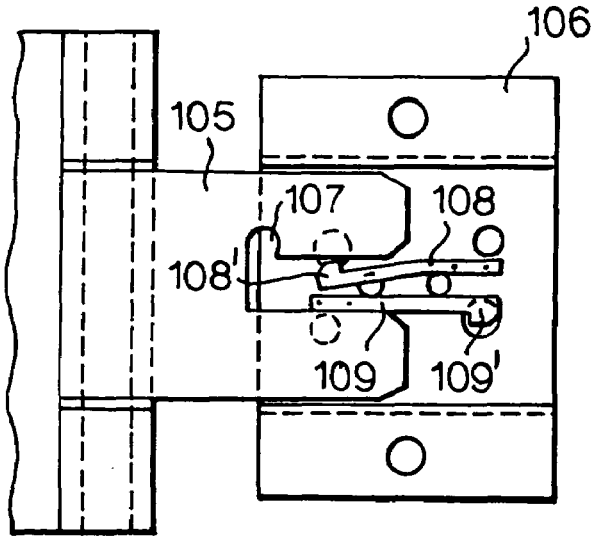
Figure 14C:
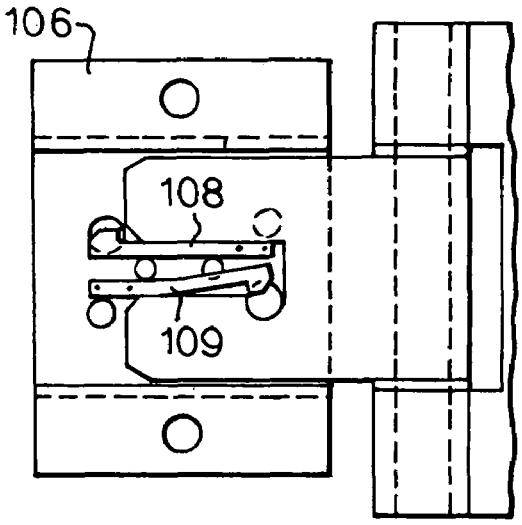
Figure 14D:
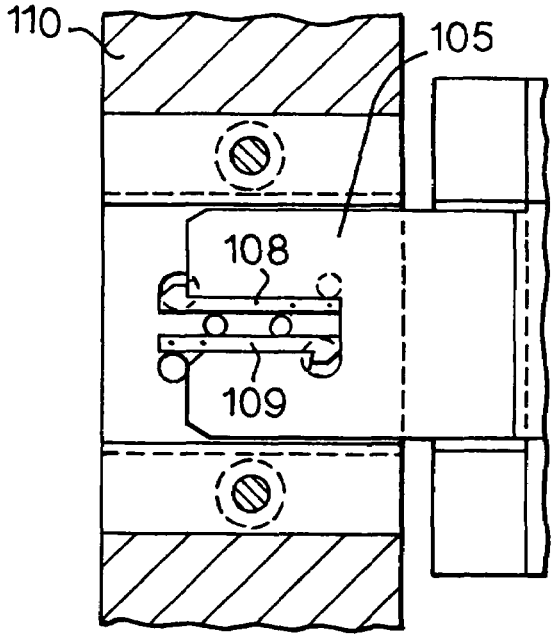
Figure 14E:
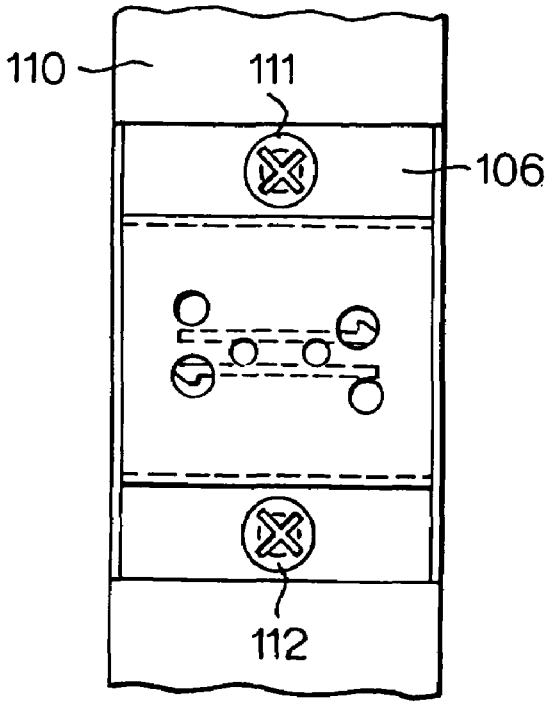
Figure 14F:
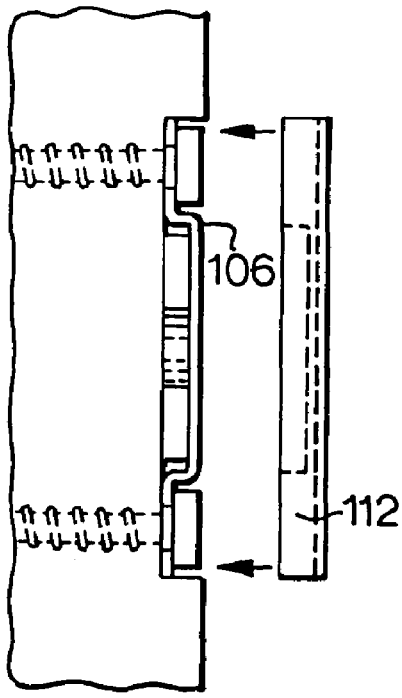
Figure 14G:
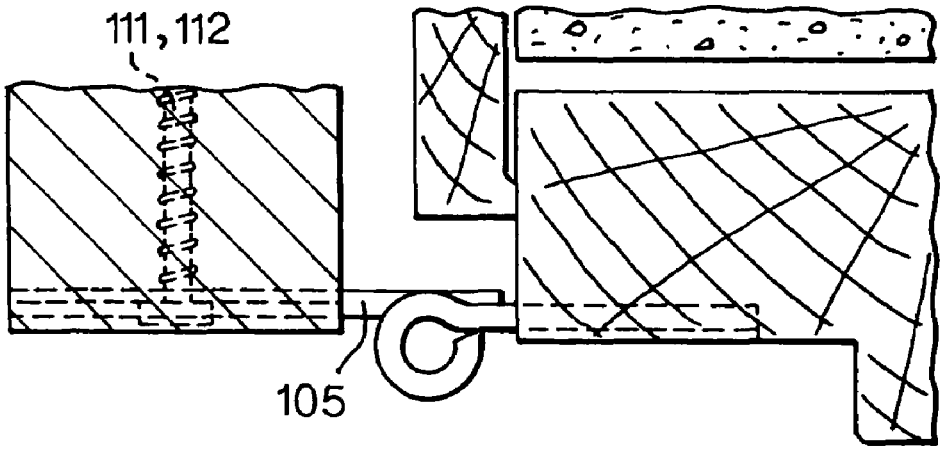
Figure 15A:
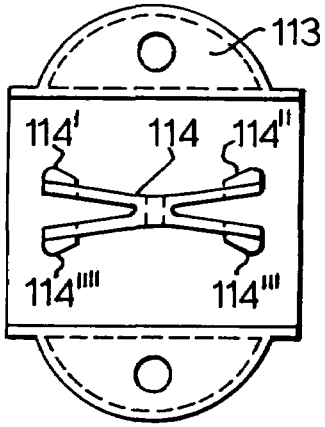
FIG. 15 shows a seventh embodiment of a hinge device of the snap-in type with details related to the mounting fitting.
Figure 15B:
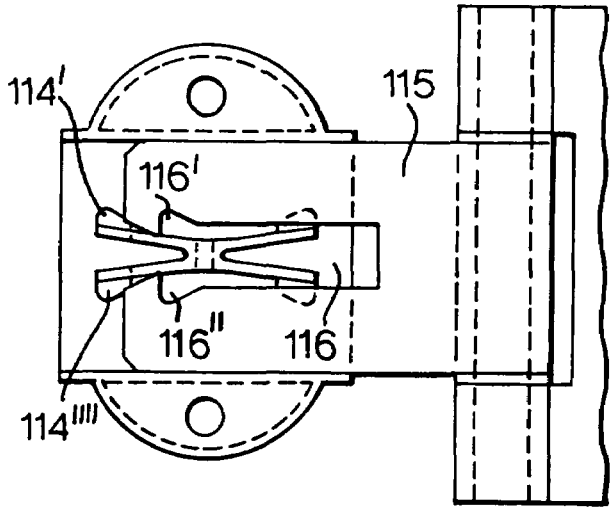
Figure 15C:
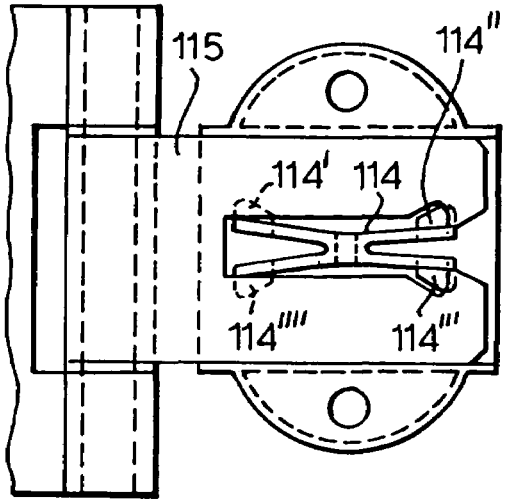
Figure 15D:
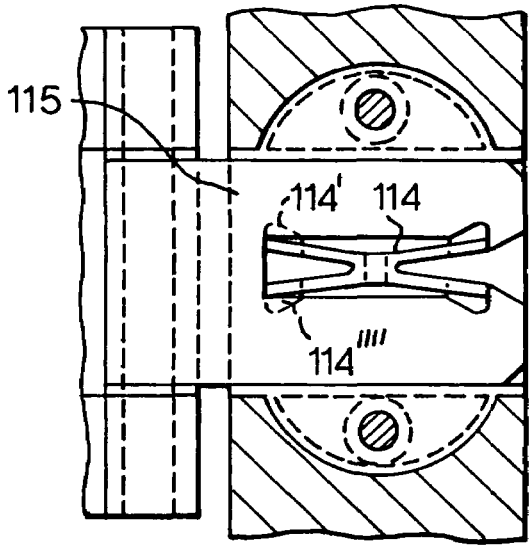
Figure 16A:
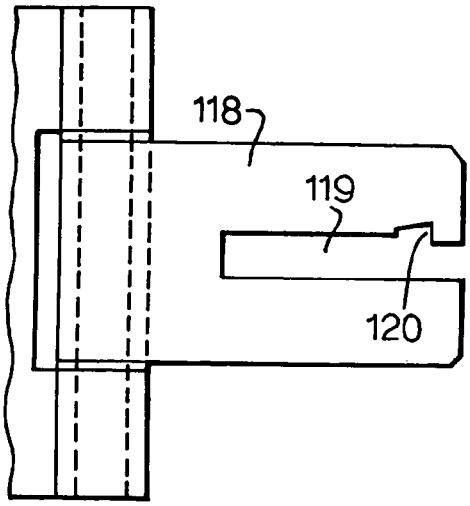
FIG. 16 shows an eighth hinge device of the snap-in type with details related to the mounting fitting.
Figure 16B:
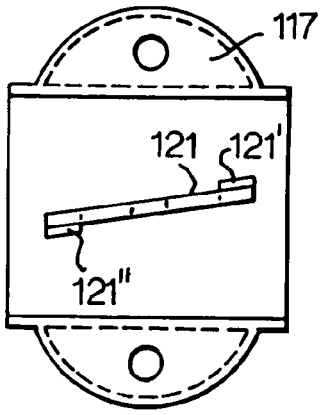
Figure 16C:
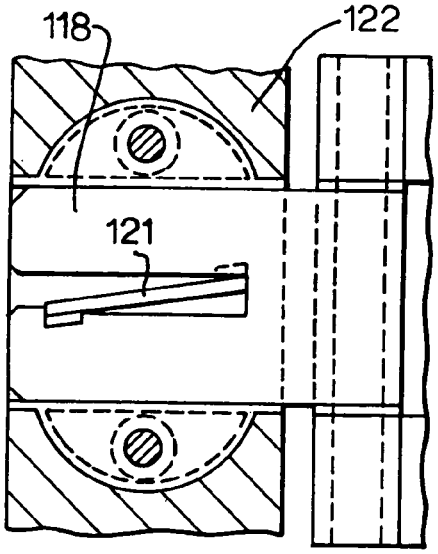
Figure 16D:
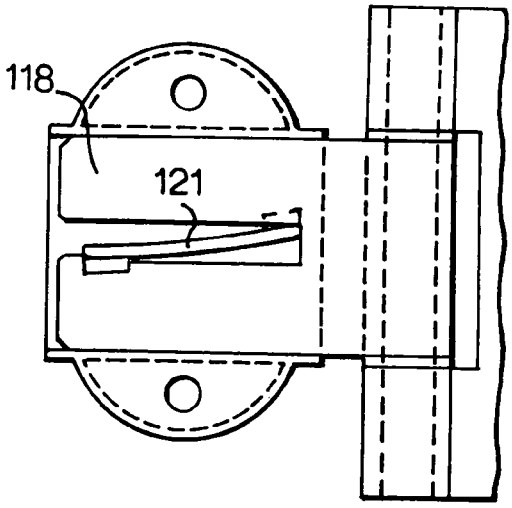
Figure 16E:
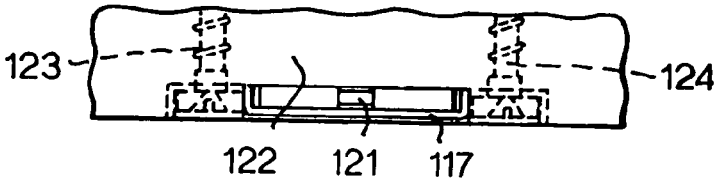

FIG. 11*d* shows how the solution illustrated in FIGS. 11*a*-11*c* can in a simple manner be converted to a depth adjustment possibility in that the male snap-in member, indicated here by the reference numeral 89, cooperates with an adjusting screw 90 located on the insertion fitting 91 to be able to move the male snap-in member 89 in an adjustable manner along the axis of movement of the hinge flap 87.

A variant of the solution shown in FIG. 10 can be seen from FIG. 12. Here, only the mounting of the male snap-in member in relation to the insertion fitting will be described. The insertion fitting is indicated by the reference numeral 92, and the male snap-in member is indicated by the reference numeral 93, and in the illustrated embodiment is made having two snap catches 93', 93". The male snap-in member has screw fixings 94, 95 for cooperation with fixing screws 94', 95' which are passed through elongate holes 94", 95" in the mounting fitting 92. Thus, adjustment of the male snap-in member in the insertion direction of the hinge flap 59 is permitted in order to provide depth adjustment of the hinge. The insertion fitting 92 is fixable in a known way per se to the door leaf 96 with fixing screws 97, 98.

FIG. 13 shows a variant of the solution shown in FIG. 11, where the male snap-in member is indicated by the reference numeral 99 for engagement with a receiving slot 86 in the hinge flap 87. The insertion fitting is indicated by the reference numeral 100. It will be seen that on insertion and snap fastening, as shown in FIG. 13*b*, the end of the hinge flap will come to rest against a branch of the male snap-in member 99, so that an exact fixing takes place between the insertion fitting 100 and the hinge flap 87. The insertion fitting 100 can be fastened to a door leaf 101 in a conventional manner with fixing screws 102, 103. To ensure that the engagement between the male snap-in member and the said receiving slot is not easily releasable, a locking pin 104 can be inserted as explained above.

It will be seen that by turning the insertion fitting 100 upside down, it will be possible to adapt this hinge easily to left-hinged and right-hinged doors.

Another variant of a hinge of the snap-in type can be seen from FIG. 14. Here the hinge flap 105 is equipped with a receiving slot 107 for cooperation with a male snap-in member 108 that is mounted on the insertion fitting 106, and where this male snap-in member 108 has a snap catch 108'. As will be understood from a study of FIG. 14*b* and FIG. 14*d* respectively, it will be possible to effect engagement between the hinge flap 105 and the insertion fitting 106, whether the hinge flap 105 is passed into the insertion fitting 106 from one side or the other. Thus, the solution shown here is especially suitable in connection with hanging right-hinged or left-hinged doors, in that two male snap-in members are provided in the illustrated solution. The second male snap-in member is indicated by the reference numeral 109 and has at its end a snap-in catch 109'. Thus, when the hinge flap 105 is pressed into the fitting from one side of the insertion fitting, one of the male snap-in members will form engagement and when the hinge flap 105 is inserted from the other side, the other male snap-in member will establish engagement.

The insertion fitting 106 can be fixed to the door leaf 110 in a known way per se. In the illustrated solution a cover 112 is provided for covering the insertion fitting and its screws and to prevent easy access to the male snap-in members.

FIG. 15 shows another variant of an insertion fitting with a male snap-in member. The insertion fitting in this case is indicated for simplicity by the reference numeral 113 and is equipped with a male snap-in member 114 which has been given an X shape with an engaging catch 114', 114", 114''' and 114'''' at the end of each branch of the X-shaped member. The hinge has a hinge flap 15 with a receiving slot 116 and catch portions thereof 116', 116" intended for respective engagement with either the engaging catches 114', 114'''' or the catches 114", 114''', depending on which side the hinge flap 115 is inserted into the insertion fitting from. As shown in FIG. 15*b*, the receiving slot of the hinge flap will engage with the catches 114', 114 '''', whilst insertion from the other side will result in the engagement taking place with the catches 114", 114''', as shown in FIG. 15*c* and FIG. 15*d*.

In the solution shown in FIG. 16 there is also an insertion fitting, here indicated by the reference numeral 117, which is to be brought together with a hinge flap 118, where this hinge flap has a receiving slot 119 with an engaging portion 120 to effect engagement with a male snap-in member 121 located on the insertion fitting 117. This male snap-in member 121 is made as a uniform body where at each end there is provided a catch, indicated by the reference numerals 121', 121". As shown in FIGS. 16*c* and 16*e*, it is possible to pass the hinge flap 118 into the insertion fitting from one side or the other thereof, depending upon whether the door to be hung is right-hinged or left-hinged.

In this illustrated solution it will not be necessary to turn the insertion fitting once it has been mounted on the door leaf 122. The insertion fitting 117 is fixable to the door leaf 122 with fixing screws 123, 124.

Figure 18A:
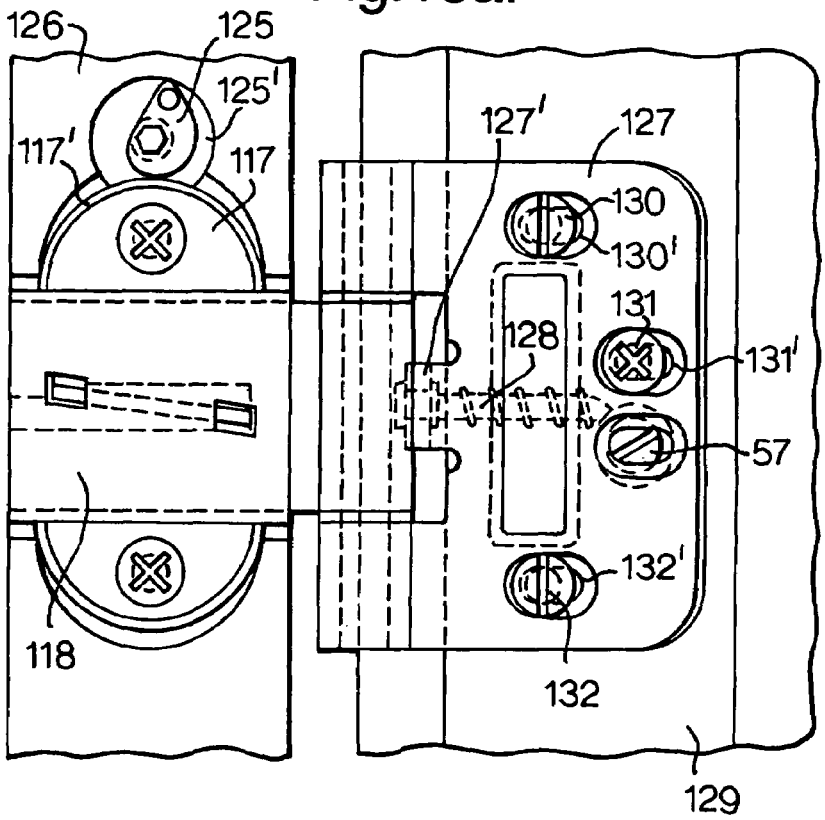
FIG. 18 shows a ninth embodiment of a hinge of the snap-in type based on a snap action principle as indicated in FIG. 16, but with height adjustment according to a seventh embodiment and depth adjustment according to the solution shown in FIG. 7.
Figure 18B:
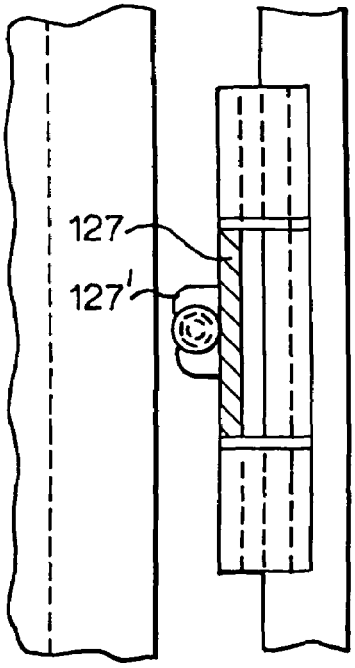
Figure 19A:
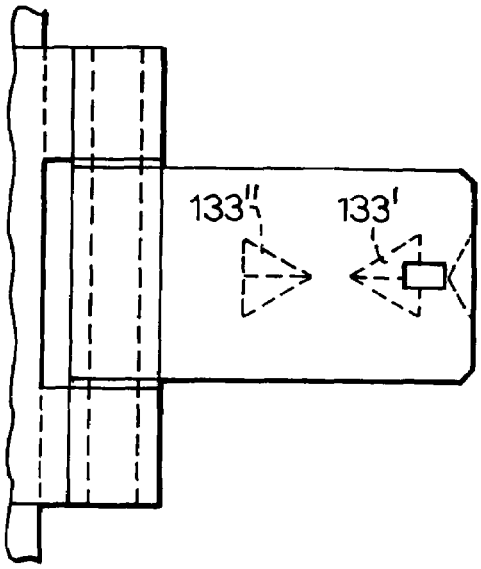
FIG. 19 shows a tenth embodiment of a hinge device of the snap-in type.
Figure 19B:
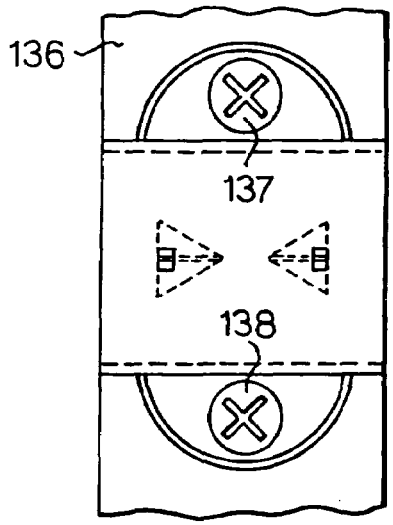
Figure 19C:
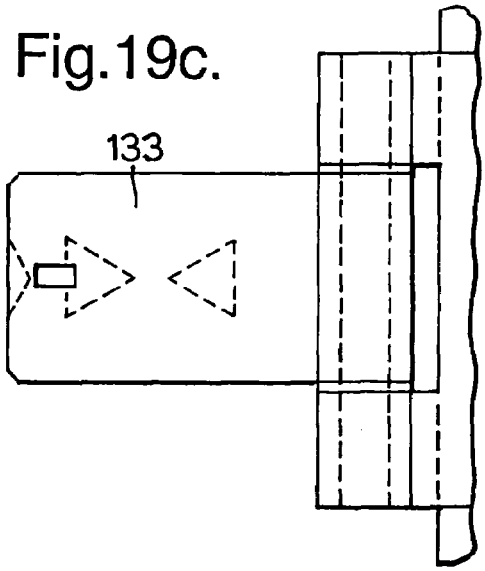
Figure 19E:
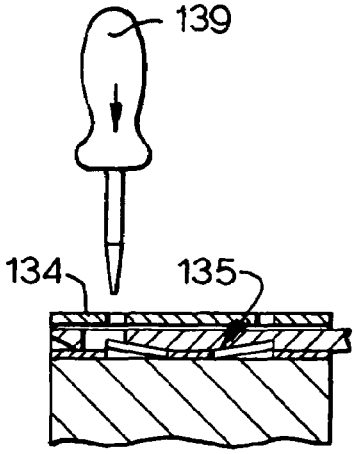
Figure 19D:
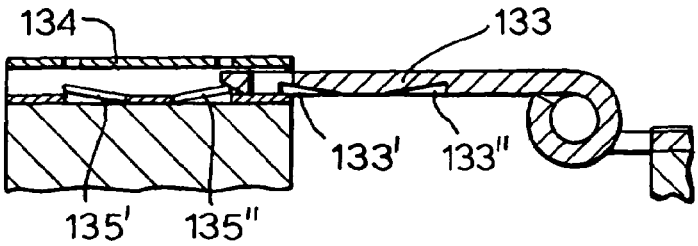
Figure 19F:
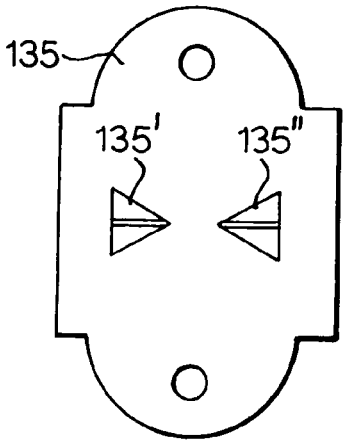
Figure 19G:
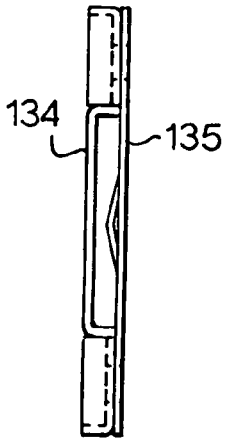
Figure 19H:
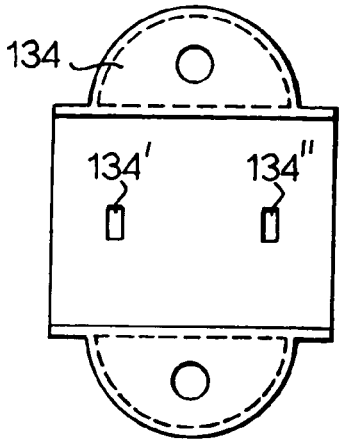
Figure 20A:
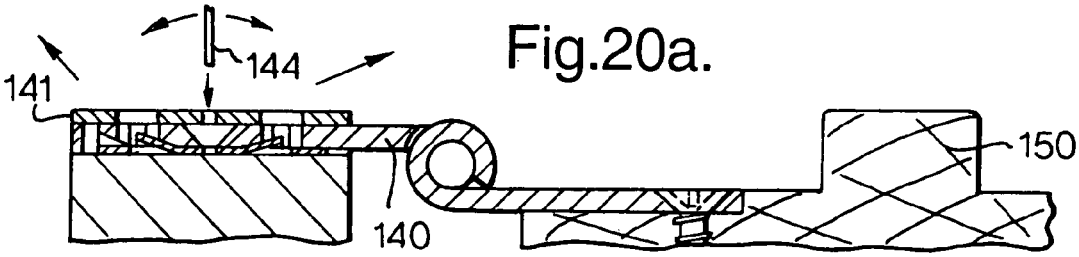
FIG. 20 shows a modification of the embodiment illustrated in FIG. 19 and represents an eleventh embodiment of a hinge device of the snap-in type, where depth adjustment of the hinge according to a fifth embodiment is permitted.
Figure 20B:
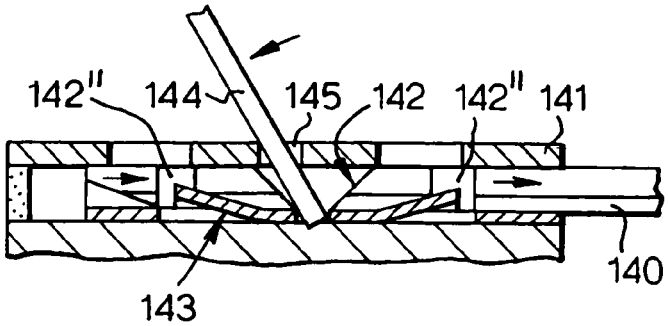
Figure 20C:
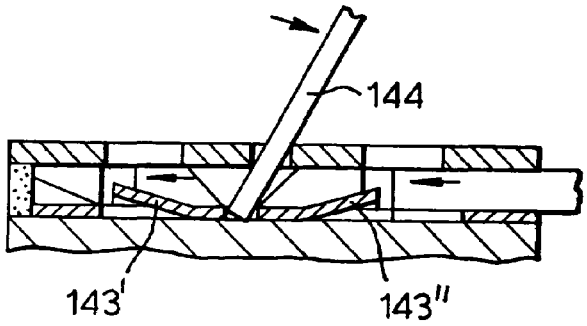
Figure 20D:
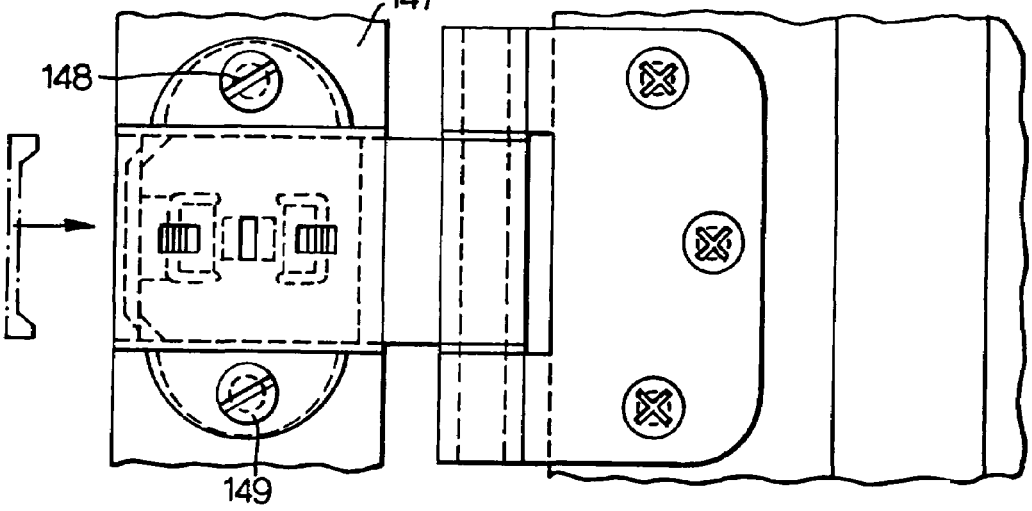
Figure 20E:
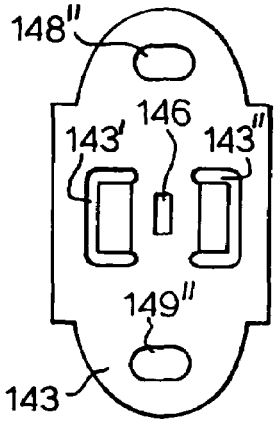
Figure 20F:
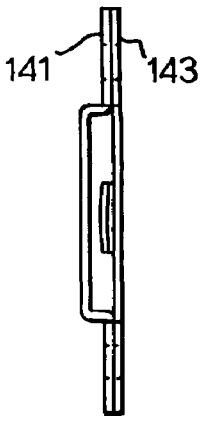
Figure 20G:
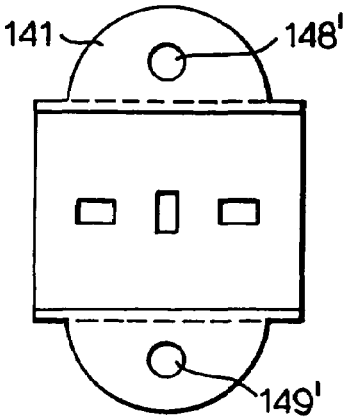

FIG. 18 shows the press-in solution that has just been described in connection with FIG. 16. However, the hinge solution apparent from FIG. 18 is intended to be height adjustable and also depth-adjustable. The height adjustment is provided by means of a pin 125 that is pivotally connected to a door leaf 126 and that is preferably equipped with a polygonal flange 125', where the respective edges or portions of the flange are at different distances from the centre of the pin. Any one of the flange edges 125' can be brought into abutment with an upper edge 117' of the insertion fitting or mounting fitting 117. Although the said pin may have a polygonal flange, it is also possible for it to have a rounded flange with the respective portions thereof at different distances from the centre of the pin.

An object of the solution shown in FIG. 18 is also that depth adjustment can be provided in a manner that has been described exhaustively in connection with the embodiment shown in FIG. 7. One of the flaps 127 of the hinge has a tongue 127' which lies at 90° to the plane of the hinge flap 127 and where this tongue 127' forms rotatable engagement with a double-headed adjusting screw 128 that is insertable into the door frame 129 parallel to the plane of the hinge flap. As also shown for the embodiment in FIG. 7, the fixing screws 130, 131, 132 of the hinge flap 127 will extend through elongate holes 130', 131 ' and 132' in order to permit movement of the hinge flap relative to the frame 129 when the screw 128 is turned. Side adjustment of the hinge takes place in the manner shown in part in FIG. 7 and described in more detail in FIG. 8. The description of this side adjustment possibility will therefore not be repeated in connection with FIG. 18. However, the side adjustment screw in FIG. 18 is indicated by the same reference numeral as in FIG. 8, namely the reference numeral 57.

FIG. 19 shows yet another embodiment of a hinge of the snap-in type where a hinge flap 133 has a receiving portion 133', 133" for cooperation with a male snap-in member 135 located on the insertion fitting 134. The male snap-in member is shown made as a uniform body, preferably of spring steel, and shaped at each end to have a catch located symmetrically about a central portion of the member, see FIG. 19*f*. Here, the respective catches are indicated by the reference numerals 135' and 135". The insertion fitting is fastened to the door leaf 136 with screws 137, 138 in the usual manner. Advantageously, the insertion fitting 134 has openings 134', 134" in its surface to enable the hinge flap 133 to be disengaged from a catch on the male snap-in member with the aid of a tool 139. As shown in FIG. 19*d*, it will be the male snap-in member 135' which forms engagement with a catch portion 133' on the hinge flap 133, whilst the catch 135" on the member 135 will limit the distance of insertion of the hinge flap 133 into the fitting 134.

The solution shown in FIG. 20 is per se constructed on the same principle as that just shown and described in connection with FIG. 19. The insertable hinge flap here is indicated by the reference numeral 140 and the insertion fitting is indicated by the reference numeral 141. The hinge flap has a receiving portion 142 with engaging portions 142', 142" for respective engagement with a male snap-in member 143 which is preferably made as a uniform body of spring steel and shaped at each end with a catch, indicated respectively by the reference numerals 143' and 143" at each end of the member 143. A tool 144 is provided for insertion into an opening 145 in the cover of the insertion fitting 141 for engagement with the centre of the receiving portion 141 on the hinge flap and also engagement with a locating opening 146 in the male snap-in member itself. The insertion fitting is fixed to the door leaf 147 by fixing screws 148, 149 which are passed through holes 148' and 149' in the insertion fitting (see FIG. 20*g*) and through elongate holes 148" and 149" in the male snap-in member 143. Movement of the tool 144 in the direction of the arrow as shown in FIG. 20*b* will result in a depth adjustment being made, whilst movement of the tool 144 as shown in FIG. 20*c* will result in an outward adjustment of the hinge being made. To make the adjustments, the screws 148 and 149 must inevitably be loosened a little, whereupon the tool 144 can move the male snap-in member 143 and at the same time the hinge flap 140 if this has been installed, and when the desired position of the door leaf relative to the door frame 150 has been obtained, the screws 148 and 149 are tightened again, whereupon the cover 141 of the insertion fitting, because of its clamping action, causes the male snap-in member 143 to be unmovable relative to the door leaf, and whereby the desired depth adjustment is thus obtained.

Figure 21A:
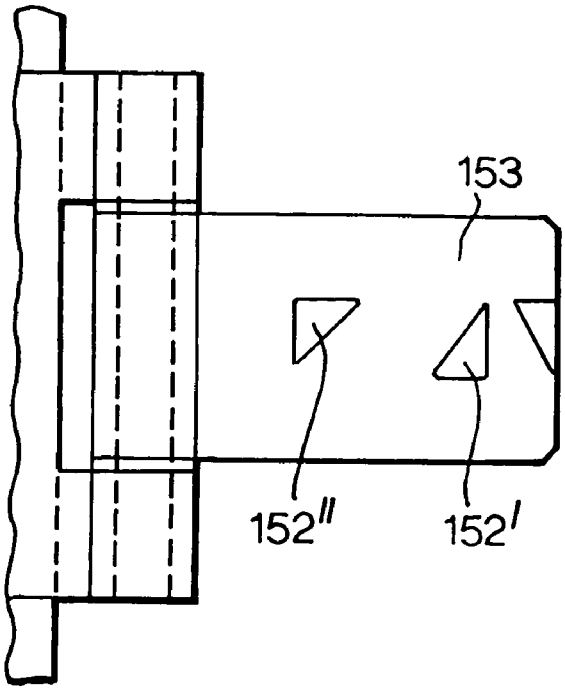
FIG. 21 shows a twelfth embodiment of a hinge device of the snap-in type.
Figure 21B:
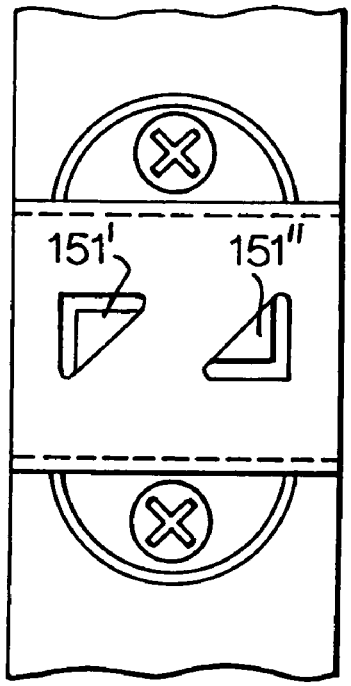
Figure 21C:
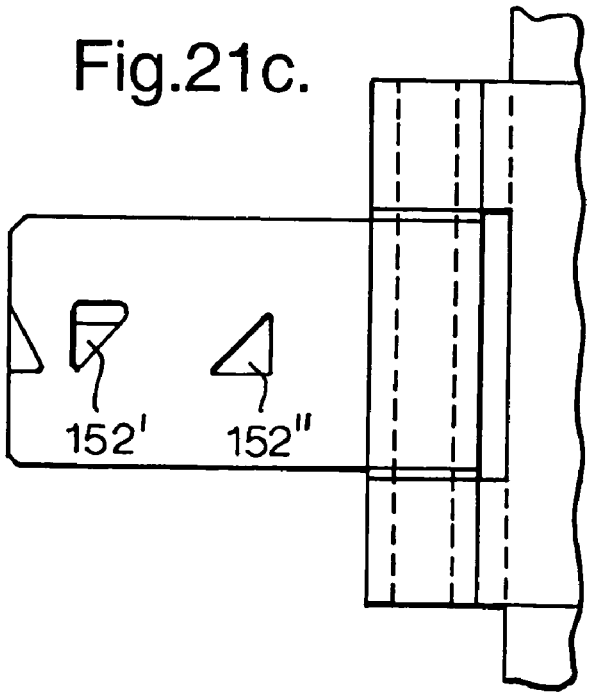
Figure 21D:
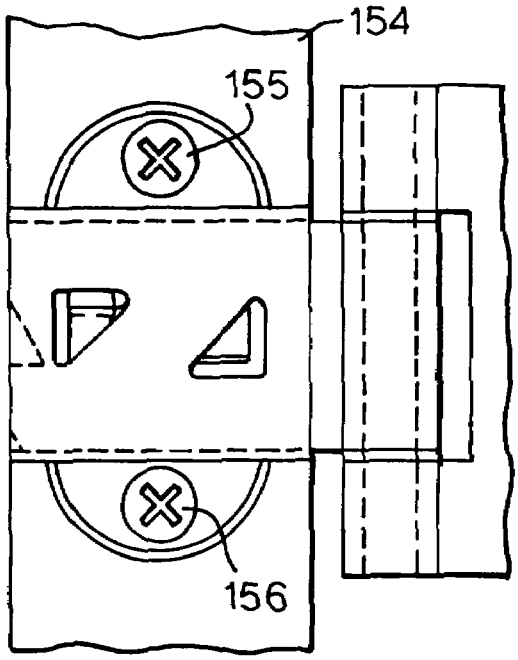
Figure 21E:
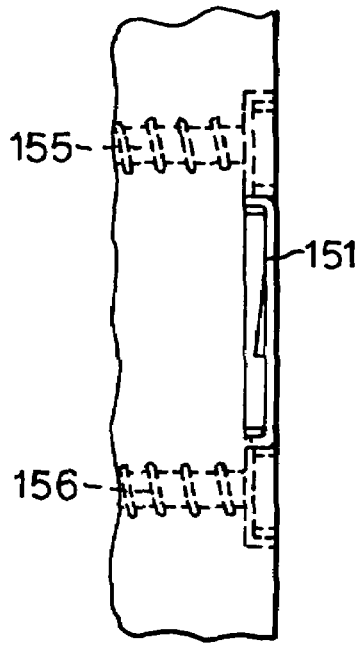
Figure 21F:
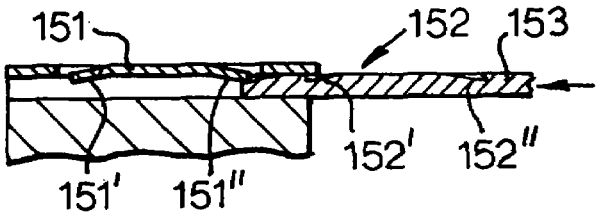
Figure 21G:
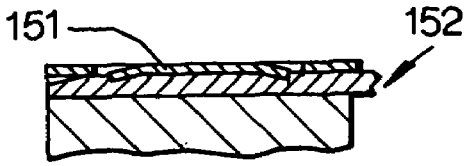

In the solutions that can be seen from FIGS. 19 and 20 respectively, it will be seen that the catches on the male snap-in member are arranged symmetrically about a centre line. In the embodiment in FIG. 21 the insertion fitting is shown having a male snap-in member 151 having catches 151.', 151" formed at each end for cooperation with a receiving portion 152 on the hinge flap 153. This receiving portion 152 has two notches 152', 152". With reference to FIG. 21*f*, it will be appreciated that the notch 152' will come into engagement with the catch 151' and similarly the notch 152' will come into engagement with the catch 151", the first-mentioned catch 151' in this case preventing the hinge flap 153 from simply being pulled out of the insertion fitting, whilst the catch 151" limits the distance that the hinge flap 153 can be inserted into the insertion fitting. In the illustrated embodiment the male snap-in member is appropriately made as a uniform body of spring steel. However, it will be seen that the male snap-in member in this case can in fact form the whole insertion fitting, and in this connection reference is made to FIG. 21*e*. The insertion fitting is attached to the door leaf 154 using conventional fixing screws 155, 156.

Thus, it will be understood from the illustrated solutions in FIGS. 19, 20 and 21, respectively, that the male snap-in member may either be within the insertion fitting adjacent the part thereof that is closest to the door leaf, or can actually constitute the part thereof that is closest to the door leaf. One alternative, as shown in FIG. 21, is also that the male snap-in member forms the insertion fitting itself.

A last embodiment of the invention can be seen in FIG. 22, also related to a hinge of the snap-in type. Here, the object is to provide side adjustment and depth adjustment. Thus, in this case too there is a hinge flap 157 which has a receiving slot 158 for cooperation with a male snap-in member 159 mounted on the insertion fitting. The male snap-in member is expediently made as a uniform body of spring steel and made having a catch 159'. At its free end, the hinge flap is equipped with a U-shaped cut-out 168 for cooperation with an adjusting screw 160 equipped with a double-flanged head 160' for providing a side adjustment of the hinge when it is screwed in and out. The insertion fitting in FIG. 22*e* is indicated by the reference numeral 161 and is to be mounted together with the male snap-in member 159. For this purpose, fixing screws (not shown) are used which are passed through holes 162, 163 in the mounting fitting and through elongate holes 162', 163' in the male snap-in member. The elongate holes 162' and 163' are provided to permit a depth adjustment of the hinge. A hole 164 is provided in the insertion fitting 161 to allow the adjusting screw 160 to be turned using a tool. In addition, a hole 165 is also provided in the insertion fitting so that on the insertion of a tool, the male snap-in member engaging catch 151 can be pushed down, thereby enabling it to disengage from the engaging portion 158 on the hinge flap 157.

Figure 22A:
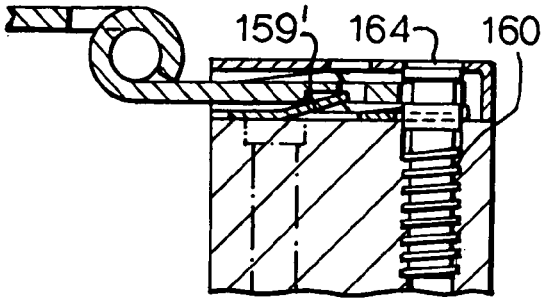
FIG. 22 shows a thirteenth hinge device of the snap-in type, where the hinge is shown with a sixth embodiment of depth adjustment and a sixth embodiment of side adjustment.
Figure 22B:
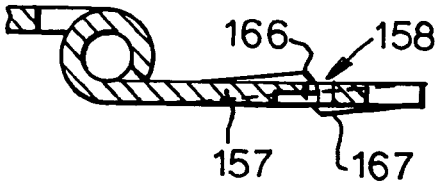
Figure 22C:
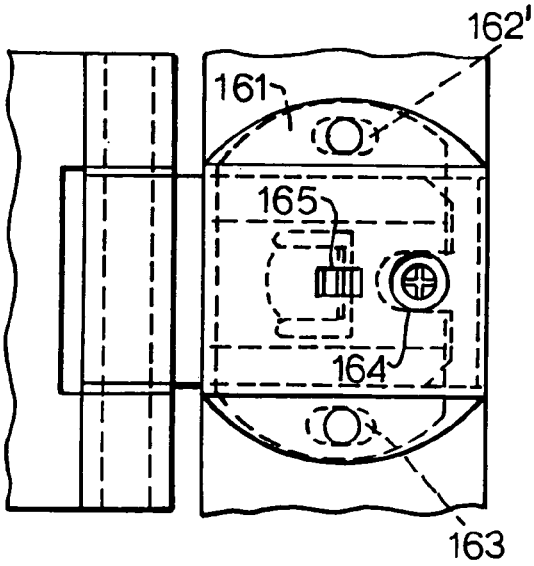
Figure 22D:
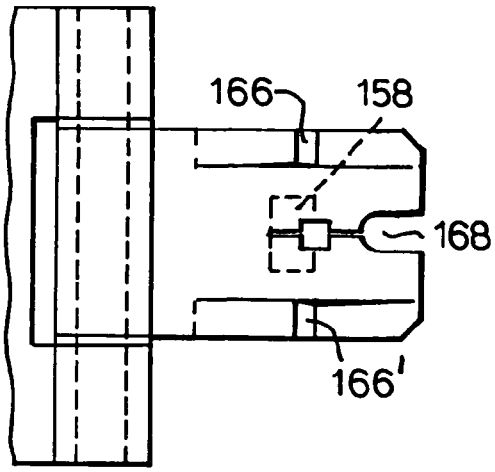
Figure 22E:
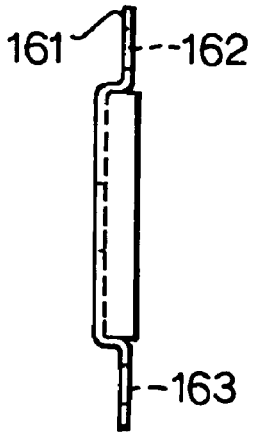
Figure 22F:
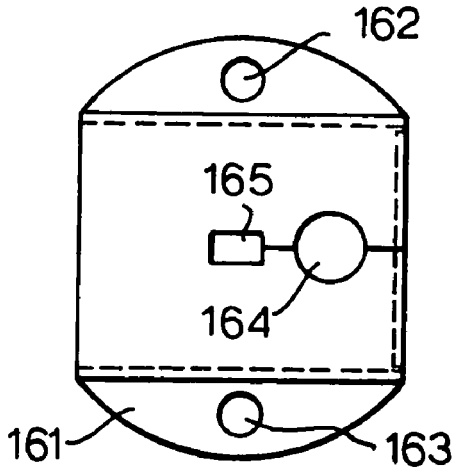
Figure 22G:
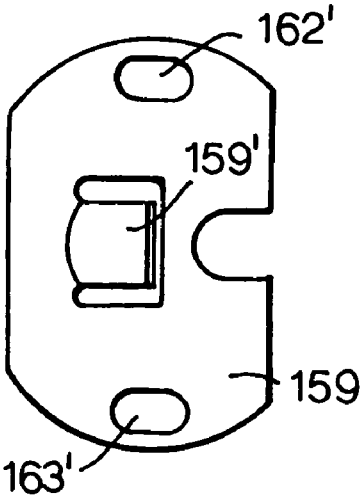
Figure 22H:
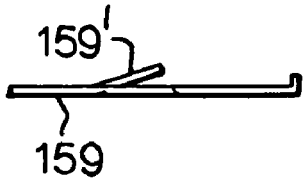
Figure 22I:
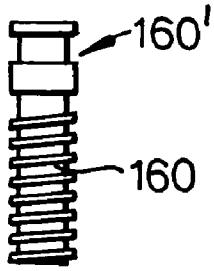

To provide an appropriate tilting of the hinge flap 157 when the screw 160 is turned, the hinge flap has preferably on opposite sides, but spaced apart in the longitudinal direction of the hinge flap, protrusions 166, 167, as shown in FIG. 22*b*, and where only the protrusions 166, 166' are visible in FIG. 22*d*.

Figure 23A:
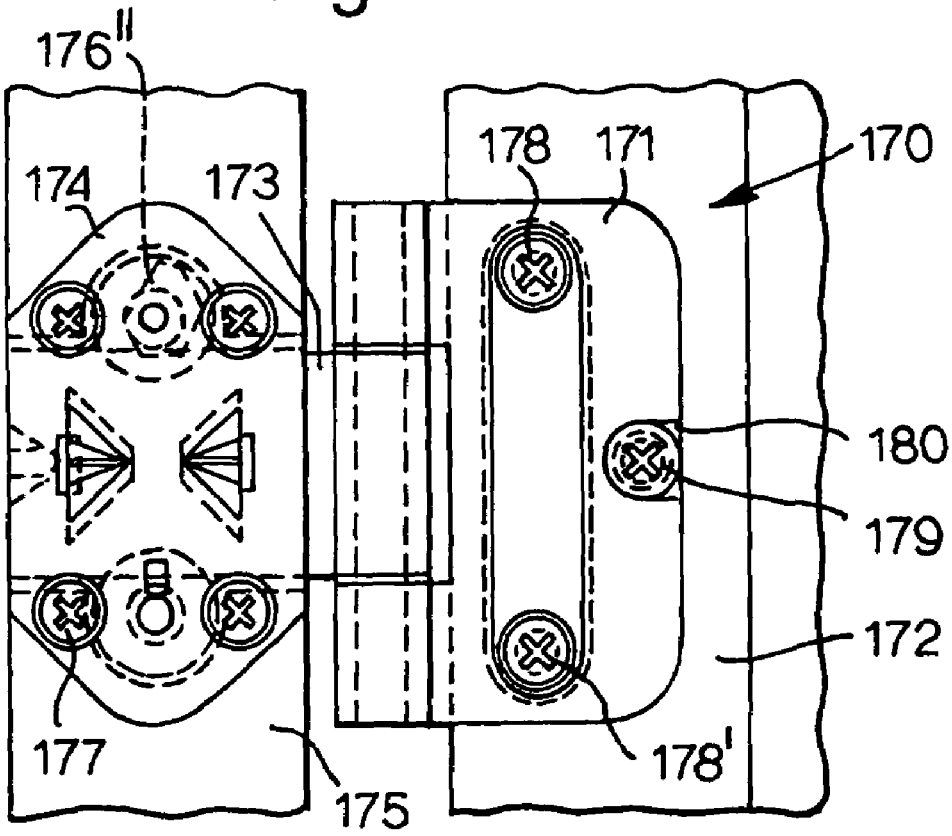
FIG. 23 shows a fourteenth hinge device of the snap-in type where the hinge is shown with a seventh embodiment of side adjustment as a variant of the embodiment in FIG. 2 and eighth embodiment of height adjustment.
Figure 23B:
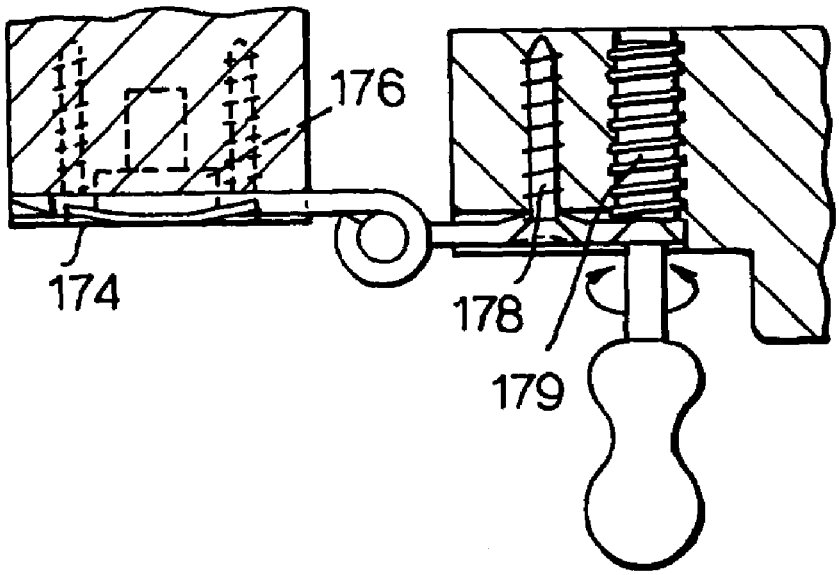
Figure 23C:
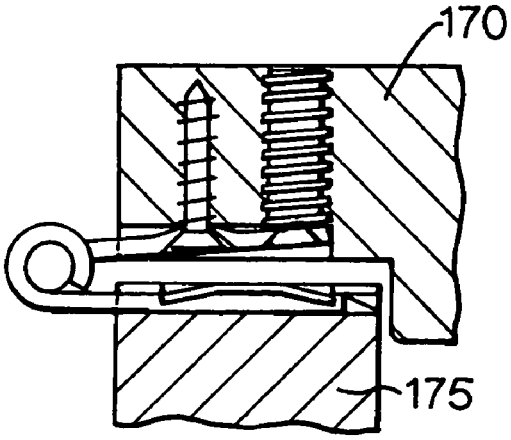
Figure 23D:
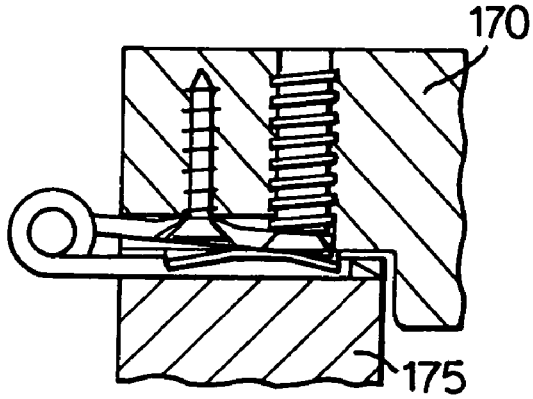
Figure 23E:
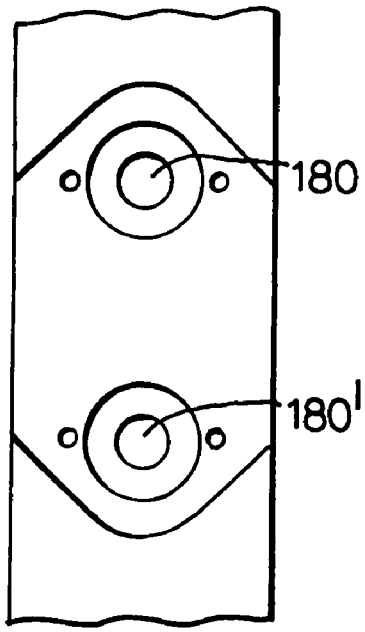
Figure 23F:
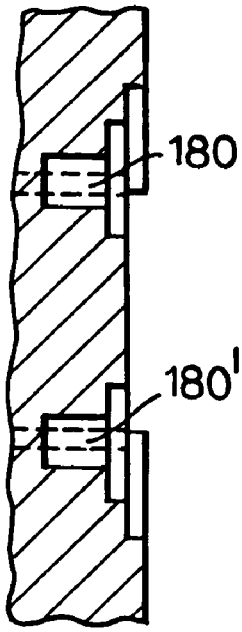
Figure 23G:
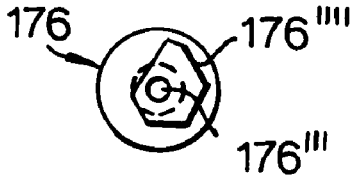
Figure 23H:
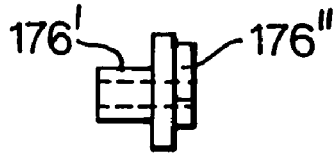

FIG. 23*a* shows a hinge 170 with a first hinge flap 171 that is fixable to a door frame 172 and a second hinge flap 173 that is insertable and fixable in an insertion fitting 174 on a door leaf 175. The fitting is fixed to the door leaf with screws 177. In connection with the insertion fitting there is a height adjustment means 176 which consists of a pin 176' that is pivotally connected to the door leaf 175 and that is equipped with a polygonal flange 176" with respective edges or portions thereof at different distances from the centre 176'" of the pin, cf. FIG. 23*g* and 23*h*. Any one of the flange edges 176 '" on the pin is capable of being brought into abutment with an upper edge of the hinge flap 173, as shown in FIG. 23*a*. FIGS. 23*e* and 23*f* show respectively a plan view of an end of a door leaf and a sectional view of the cut-outs 180, 180' required in the door leaf to receive the means 176, the insertion fitting 174 and mounting screws 177. Side adjustment is permitted by having in the hinge flap 171 fixing screws 178, 178', and adjusting screw 179 which is double-headed and can be screwed into the door frame (FIGS. 23*b*-23*d*). The screw 179 with its double head is advantageously insertable into an end opening 180 in the hinge flap 171. Screwing the screw 179 either into the frame 170 or out of the frame 170 as shown in respectively FIGS. 23*c* and 23*d* using a tool, for example, a screw driver, will result in side adjustment to the right and the left respectively.

FIG. 24 shows a hinge where one of the hinge flaps 181 is fixed to the door frame 182 by two screws 183 and 183' and where an adjusting means 184 is provided to allow side adjustment of the hinge. The means 184 consists of a first screw body 184' which can be screwed into or out of the door frame 182 for abutment with the rear side of the hinge flap 181 and a fixing screw 184". In connection with an insertion fitting 186, there is a height adjustment means 187 similar to the means 176 and which is pivotally connected to a door leaf 188. The fitting 186 is fixed to the door leaf with screws 189, 189', 189'". Any flange edge 187' on the means 187 can be brought into abutment with an upper edge of a hinge flap 190 that can be fastened to the fitting 186, as shown in FIG. 24*a*. A hinge joint 185 with a common pivot joins the two hinge flaps. FIG. 24*c* shows the door leaf 188 adjusted to a lower position by using the means 187, whilst FIG. 24*d* shows the door leaf 188 in an upper position. FIG. 24*e* shows the screw body 184' in an outer position, adjusted using an Allen key (not shown) passed through a screw hole in the hinge flap 181 intended for the screw 184". Thus, FIG. 24*e* shows the door leaf 188 in a position as far to the right as possible, whilst FIG. 24*f* shows adjustment of the door leaf 188 as far as possible to the left.

Figure 24A:
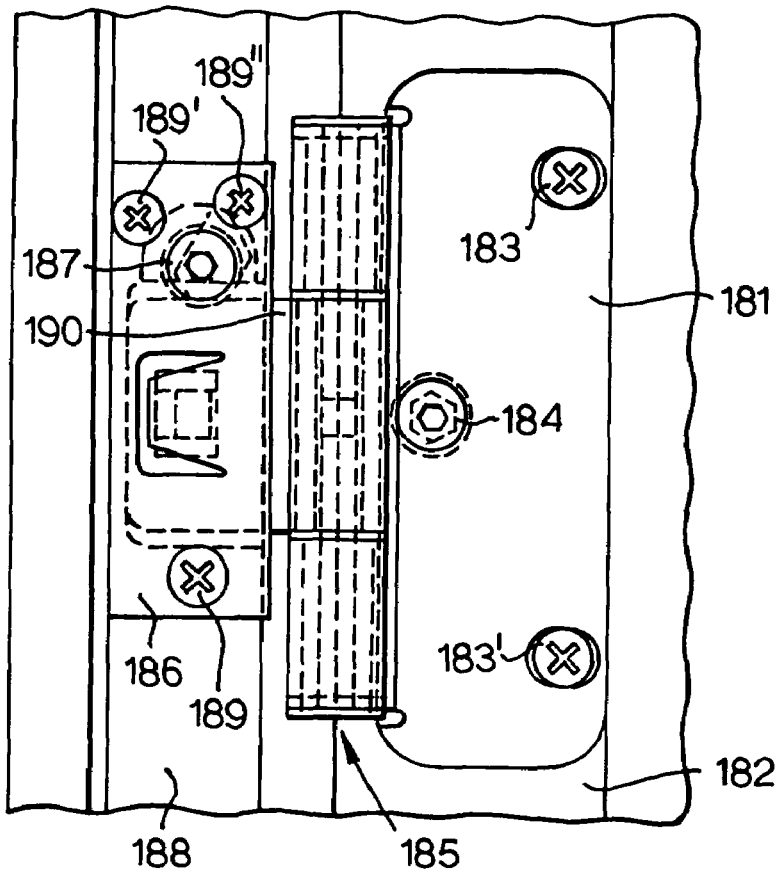
FIG. 24 shows a fifteenth hinge device of the snap-in type with the eighth embodiment of side adjustment and a ninth embodiment of height adjustment.
Figure 24B:
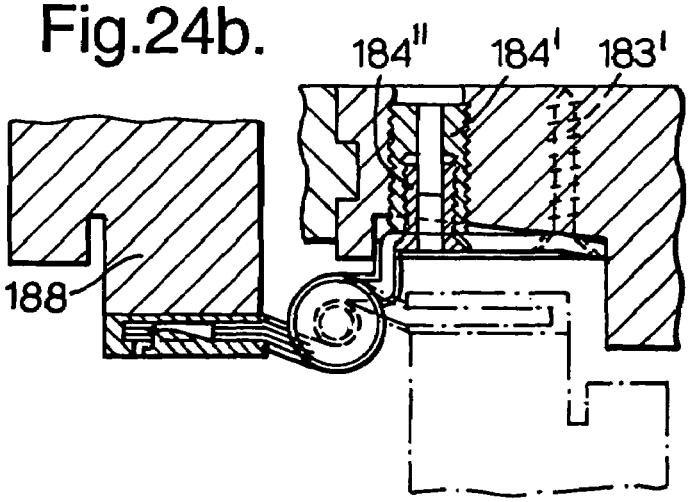
Figure 24C:
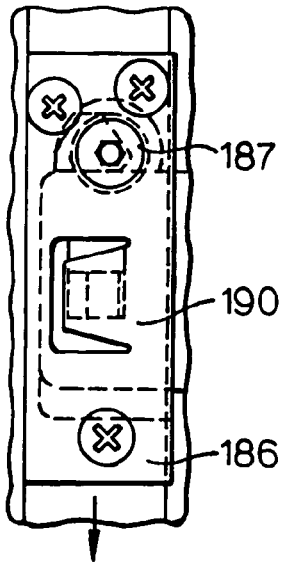
Figure 24D:
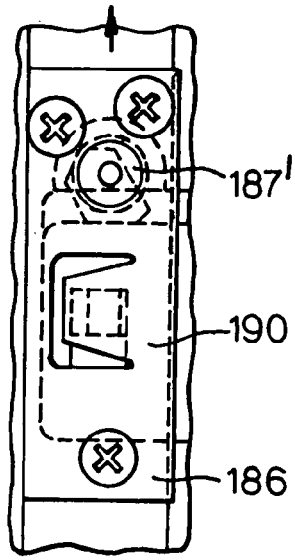
Figure 24E:
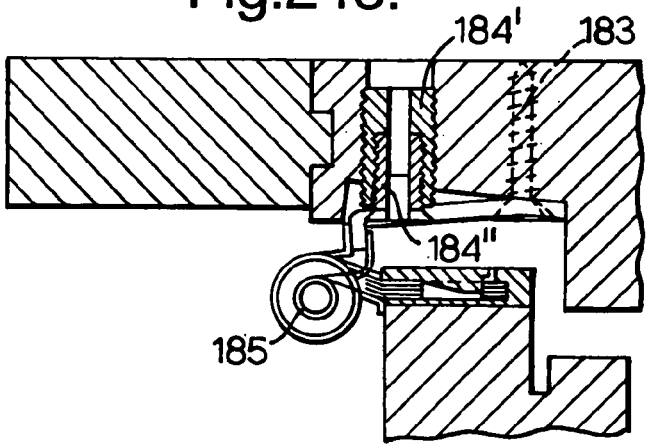
Figure 24F:
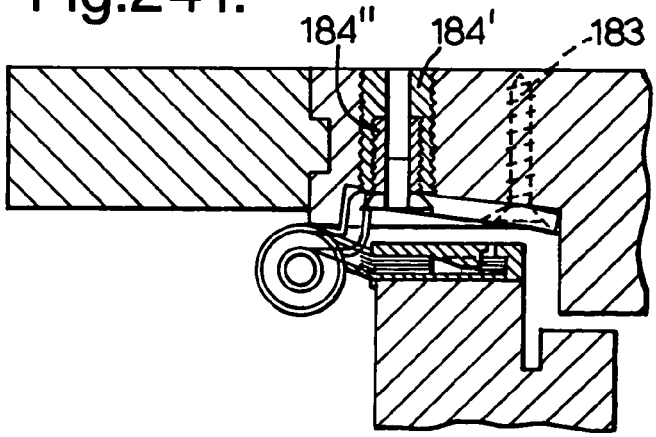
Figure 25A:
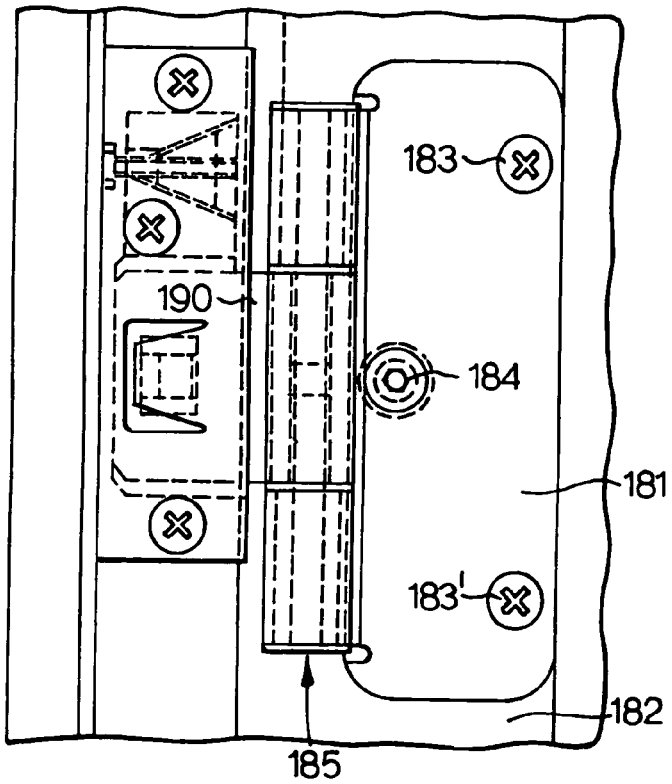
FIG. 25 shows a sixteenth hinge device of the snap-in type with the eighth embodiment of side adjustment and a tenth embodiment of height adjustment.
Figure 25B:
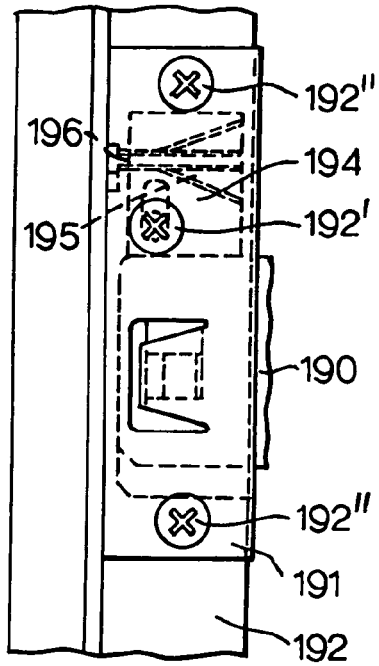
Figure 25C:
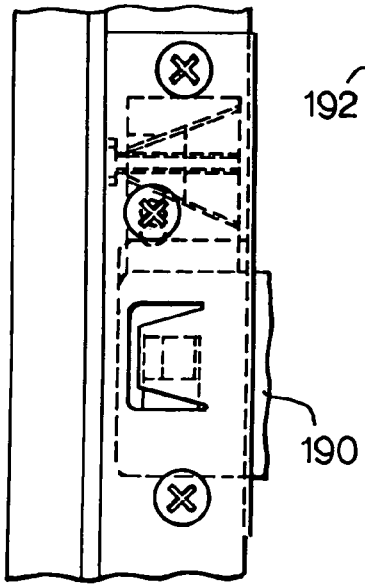
Figure 25D:
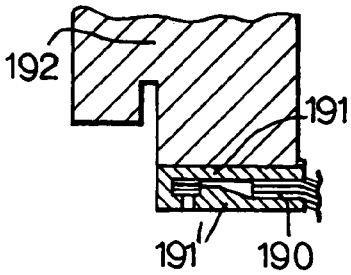
Figure 25E:
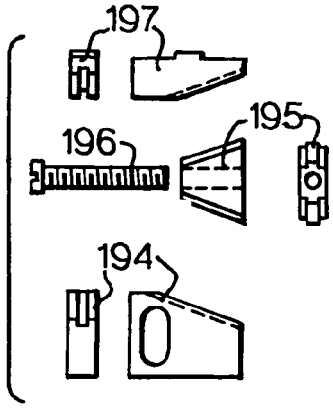

FIG. 25*a* shows on the right the same solution as that in FIG. 24*a* with the same possibility of side adjustment of the hinge. As shown on the left in FIG. 25*a*, and also in FIGS. 25*b* and 25*c*, the hinge flap 190 can be snapped into a mounting fitting 191 and thereat movable in the mounting fitting or door leaf 192. The mounting fitting is fixed to the door leaf with screws 192, 192', 192", and a means 193 is provided at the uppermost area of the fitting for height adjustment of the door leaf. This means 193 consists of a wedge device mounted on the door leaf and in cooperation with the fitting, where the means is steplessly movable parallel to the upper edge of the hinge flap 190 so that with the aid of a wedge 195 it can urge a slide 194 bearing against the upper edge of the hinge flap 190 to move either up or down. The movement of the wedge 195 is controlled by an adjusting screw 196. FIG. 25*d* shows a section through the door leaf at the snap-in point of the hinge flap 190 into the insertion fitting or mounting fitting 191. The fitting 191 has an engaging spring 191 ' for snap engagement with, for example, a hole in the hinge flap 190. FIG. 25*e* shows details associated with the wedge device. The reference numeral 197 denotes an upper gib along which the wedge 195 moves. The gib is stationary relative to the fitting. The wedge 195, the gib 197 and the slide 194 are shown in side view and end view respectively.

Figure 26A:
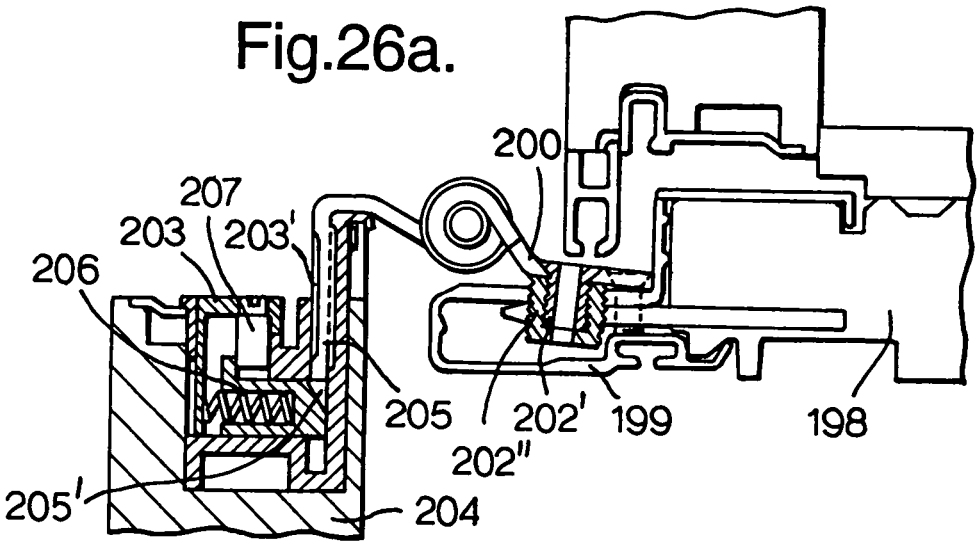
FIG. 26 shows a seventeenth hinge device of the snap-in type with the eighth embodiment of side adjustment, but an eleventh embodiment of height adjustment, and with a special solution for snap engagement.
Figure 26B:
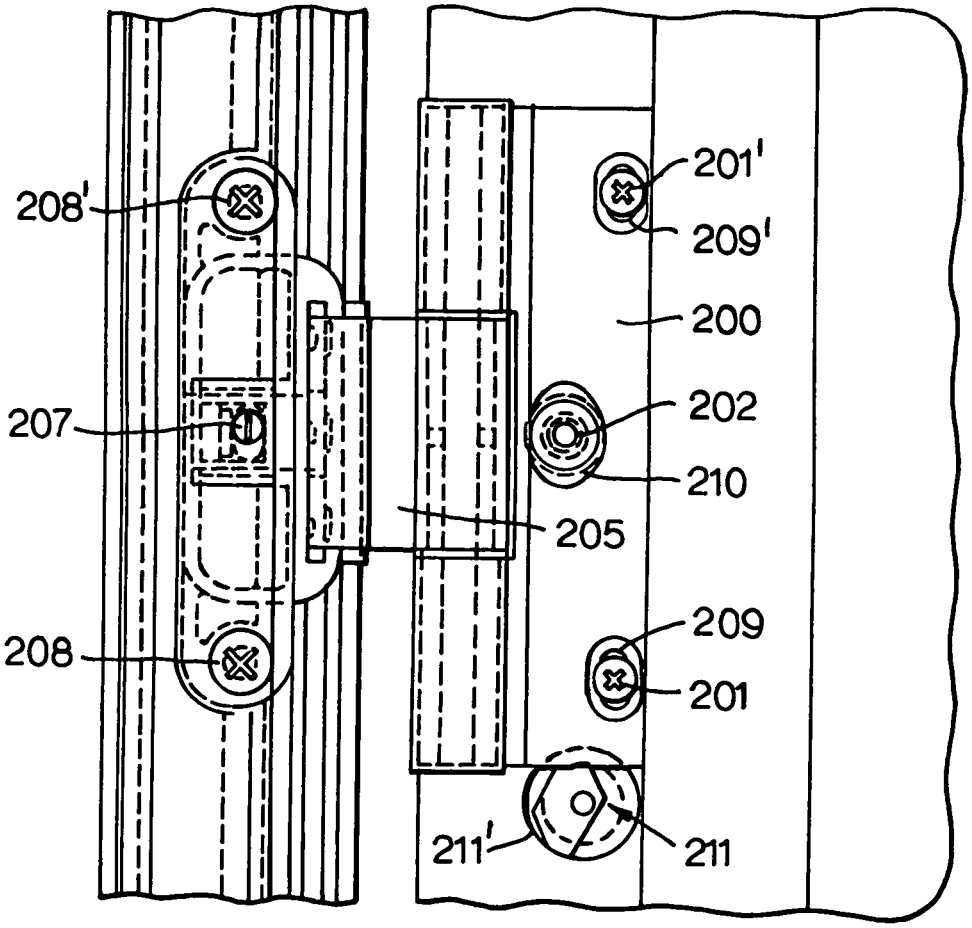

FIG. 26 shows a solution for side adjustment as shown in FIGS. 24 and 25. The hinge flap which is fixable to a door frame 198 or frame fitting 199 is indicated by the reference numeral 200. Screws 201, 201' and adjusting means 202 fix the hinge flap 200 to the door frame. An adjustable screw body 202' is fastened into the frame or frame fitting for abutment with the rear side of the hinge, and a screw 202" can be fastened into the screw body 202' through a hole in the hinge flap 200 in order to fix the hinge flap to the screw body 202', simultaneous angular adjustment of the hinge flap 200 relative to an adjacent portion of the frame being carried in cooperation with a locating portion on the door frame or frame fitting and said fixing screws 201, 201'. It will be seen that in the illustrated solution, the insertion fitting 203 pocket 203' extends parallel to the major faces of the door leaf 204. When the flap 205 of-the press-in hinge is inserted into the pocket 203', a spring-loaded catch 206 is pushed to the side, whereupon the catch by spring action moves into an engaging hole 205' in the hinge flap 205. If a hung door is to be released from engagement with the catch 206, a screw 207 made having an eccentric part is turned so that the catch is pushed against spring action out of engagement with the hinge flap 205. The insertion fitting 203 is fixed to the door leaf 204 with screws 208, 208'. In addition, it will be seen that the screws 201, 201' and the adjusting means 202 are related to elongate holes 209, 209' and 210, so that it is possible to adjust the hinge vertically by using a stepwise adjustable height adjustment means 211 which has a pin and a polygonal flange with the respective edges of the flange at different distances from the centre of the pin, and where the means 211 is pivotally mounted in the frame 198 or frame fitting 199. In this way, any one of the flange edges 211' can be brought against the lower edge of the hinge flap 200.

Figure 27A:
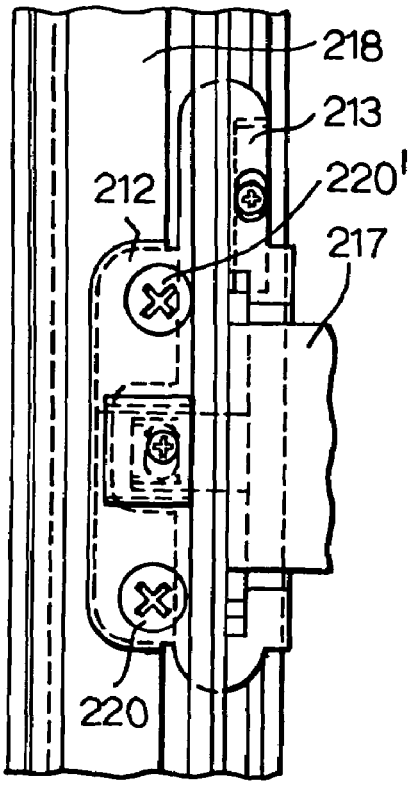
FIG. 27 shows an eighteenth hinge device of the snap-in type with a twelfth embodiment of height adjustment and with a solution for snap engagement like the solution in FIG. 26.
Figure 27B:
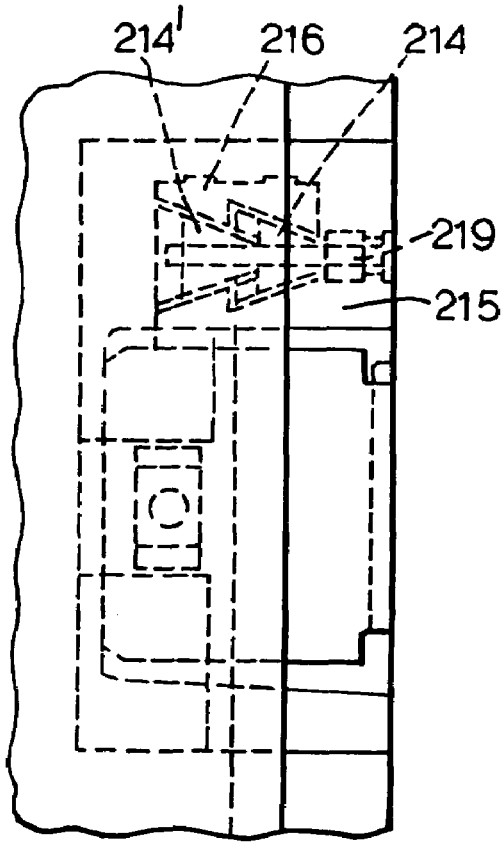

FIGS. 27*a* and 27*b* show a hinge construction which is equivalent to that which in part is shown in FIG. 25 and in part in FIG. 26, but with the difference that in the insertion fitting 212 there is a height adjustment means 213, instead of the height adjustment means 211 in FIG. 25. The hinge press-in leaf for insertion into the fitting 212 and snap-locking thereto is indicated by the reference numeral 217. The insertion takes place in an insertion pocket parallel to the major faces of the door leaf 218. The means consists of a wedge device 214, 214', for example, a double wedge, that is movable in relation to a stationary gib 216 and a slide 215 that is movable up and down. The movement of the wedge device 214, 214' is effected by an adjusting screw 219. The screws 220, 220' fasten the fitting to the door leaf 218.

FIGS. 28*a* and 28*b* show a hinge construction which is a modification of that shown on FIGS. 5 and 27. A hinge flap 221 is mounted on a door frame 222 by means of screws 223, 224 and has adjustment means 225 for side adjustment of the hinge. A hinge flap insertion fitting 226 for snap-engagement with another hinge flap 227 is mounted on an end face of a door leaf 228. The fitting 228 is attached to the door leaf by means of screws 229, 230. The fitting has a snap-tongue 231 capable of releasable snapping into engagement with a hole or recess 227' on the hinge flap 227. A height adjustment is made possible through use of a wedge arrangement having a stationary wedge member 232 and a horizontally adjustable wedge member 233 which rides on a vertically moveable slide 234. The slide 234 rides on an upper edge of the hinge flap 227, and when the wedge 233 is adjusted, the slide 234 and thus the hinge flap 227 will move either up or down. A screw member 235 interacts with the wedge member 233 to move it one or the other way horizontally. It is possible through a view hole 236 in the fitting 226 to observe the actual position of the upper edge of the hinge flap 227. It is seen that the wedge members 232, 233 as well as the slide 234 extend into the door leaf 228 parallel to a large face thereof, rather than lying parallel with the narrow end face of the door leaf. Thereby, the adjustment screw 235 becomes less visible.

On the basis of the illustrated embodiments of the device according to the invention, it will be understood that height adjustments, depth adjustments and side adjustments can be made in a simple manner both with hinges of a conventional type per and of the press-in type, and that the different technical solutions may be easily combined so that for a single hinge it will be possible to provide at least one of the following properties; height adjustment, depth adjustment and side adjustment.

I claim:

1. An adjustable door hinge device for a door assembly comprising:

(a) a door leaf and a door frame, said hinge device having a first one of its hinge flaps fixable with screws to the door frame, and a second one of its hinge flaps attachable to the door leaf of the door assembly, said first and second hinge flaps each of a single piece flat member portions of which in a closed state of the door assembly are facing each other in a recess of the door frame, (b) wherein an adjustable screw body is adjustably fastened in a vertical member of the door frame for abutment with part of a rear face of the flat face portion of the first hinge flap, (c) wherein a fastening screw to extends through a hole in the flat member portion of the first hinge flap and engages a threaded axial hole in said screw body and abuts part of a front face of the first hinge flap, (d) wherein through holes in the first hinge flap are provided for receiving screw members therethrough, said screw members in cooperation with said adjustable screw body and its engageable fastening screw configured to attach the first hinge flap to the door frame vertical member, and (e) wherein said fastening screw and said adjustable screw body, as well as said screw members provide for angular adjustment and fixing of the hinge flap relative to an adjacent portion of the door frame vertical member facing the rear side of the first hinge flap and in cooperation with a tilting location on the hinge flap.

2. An adjustable door hinge device according to claim 1, wherein said tilting location is at a rear end of the first hinge flap adjacent to said screw members and in cooperation with an adjacent locating portion on the door frame member.

3. An adjustable door hinge device according to claim 1, further wherein the second one of its hinge flaps is configured to be releasably snapable into a mounting fitting or an insertion fitting affixed to the door leaf of the door assembly.

4. An adjustable door hinge device according to claim 3, wherein the mounting fitting or the insertion fitting has a height adjustment member for adjusting the position of the second hinge flap relative to the door leaf.

5. An adjustable door hinge device according to claim 1, wherein said tilting location is at a rear end of the first hinge flap adjacent to said screw members and in cooperation with an adjacent recessed locating portion on the door frame member.

6. An adjustable door hinge device according to claim 1, further wherein the second one of its hinge flaps is configured to be releasably insertable into a pocket of a mounting fitting or an insertion fitting affixed to a vertical transverse end of the door leaf of the door assembly.

* * * * *